US012258185B2

(12) United States Patent
Kvam et al.

(10) Patent No.: US 12,258,185 B2
(45) Date of Patent: Mar. 25, 2025

(54) PAPER-BASED OR PAPERBOARD-BASED CONTAINER AND RELATED METHODS

(71) Applicant: Elopak ASA, Spikestad (NO)

(72) Inventors: Gerd Unni Kvam, Hokksund (NO); Martin Knut Wieser, Vettre (NO)

(73) Assignee: Elopak AS, Spikkestad (NO)

( * ) Notice: Subject to any disclaimer, the term of this patent is extended or adjusted under 35 U.S.C. 154(b) by 46 days.

(21) Appl. No.: 17/790,761

(22) PCT Filed: Jan. 8, 2021

(86) PCT No.: PCT/EP2021/050260
§ 371 (c)(1),
(2) Date: Jul. 5, 2022

(87) PCT Pub. No.: WO2021/140192
PCT Pub. Date: Jul. 15, 2021

(65) Prior Publication Data

US 2023/0015058 A1 Jan. 19, 2023

(30) Foreign Application Priority Data

Jan. 10, 2020 (EP) ..... 20151241
Jul. 9, 2020 (NO) ..... 20200803

(51) Int. Cl.
*B65D 5/06* (2006.01)
*B65B 43/10* (2006.01)
(Continued)

(52) U.S. Cl.
CPC ..... *B65D 5/064* (2013.01); *B65B 43/10* (2013.01); *B65D 5/0209* (2013.01);
(Continued)

(58) Field of Classification Search
CPC .... B65D 5/064; B65D 5/0209; B65D 5/4266; B65D 5/727; B65D 5/746; B65D 65/40;
(Continued)

(56) References Cited

U.S. PATENT DOCUMENTS 3,109,574 A 11/1963 Lange
4,819,839 A 4/1989 Carlsson et al.
(Continued)

FOREIGN PATENT DOCUMENTS

DE 69817486 T2 7/2004
EP 1591367 11/2005
(Continued)

OTHER PUBLICATIONS

P27162JPC Application 2022542362 OA dated 20.9.24 with English translation.

*Primary Examiner* — Christopher R Demeree
(74) *Attorney, Agent, or Firm* — Christian D. Abel

(57) ABSTRACT

A paper-based or paperboard-based container (100) for holding a pourable food product is described, the container comprising: a substantially planar bottom portion; a top portion arranged opposite the bottom portion and comprising a top panel and a top sealing region (126) forming a top seal of the container; and a wall portion extending between the bottom portion and the top portion and comprising a plurality of wall sections (108*b*, 108*c*) bordering the top panel and a longitudinal sealing band (14) extending between the bottom portion and the top portion and over at least one of the wall sections, wherein the top sealing region is folded onto said at least one of the wall sections comprising the longitudinal sealing band (14) and being attached thereto. A blank and a sleeve for producing the container is also described, as is a method for producing the container.

19 Claims, 16 Drawing Sheets

(51) Int. Cl.

| | |
|---|---|
| ***B65D 5/02*** | (2006.01) |
| ***B65D 5/42*** | (2006.01) |
| ***B65D 5/72*** | (2006.01) |
| ***B65D 5/74*** | (2006.01) |
| ***B65D 65/40*** | (2006.01) |
| ***B65D 85/72*** | (2006.01) |

(52) U.S. Cl.
CPC ..... *B65D 5/4266* (2013.01); *B65D 5/727* (2013.01); *B65D 5/746* (2013.01); *B65D 65/40* (2013.01); *B65D 85/72* (2013.01)

(58) Field of Classification Search
CPC ..... B65D 85/72; B65D 5/0227; B65D 5/029; B65D 5/747; B65D 85/80; B65D 5/061; B65D 5/40; B65D 5/067; B65D 5/42; B65D 5/72
USPC .... 229/125.01, 125.15, 125.42, 137, 117.24, 229/138; 222/81
See application file for complete search history.

(56) References Cited

U.S. PATENT DOCUMENTS

| | | | | |
|---|---|---|---|---|
| 6,182,887 | B1 * | 2/2001 | Ljunstrom | B65D 73/0028 229/137 |
| 9,327,862 | B2 * | 5/2016 | Barbieri | B65D 5/0209 |
| 2004/0169066 | A1 * | 9/2004 | Palm | B65D 5/067 229/110 |
| 2007/0170233 | A1 | 7/2007 | Fontanazzi | |
| 2019/0106239 | A1 | 4/2019 | Dammers et al. | |
| 2021/0178348 | A1 * | 6/2021 | Sasso | B65D 5/541 |

FOREIGN PATENT DOCUMENTS

| | | | |
|---|---|---|---|
| EP | 2392517 | A1 | 6/2010 |
| JP | 60-115823 | U | 8/1985 |
| JP | 60-217968 | | 10/1985 |
| JP | 3-111925 | U | 11/1991 |
| JP | 2004-224411 | | 8/2004 |
| WO | WO00/63081 | A2 | 10/2000 |
| WO | 2009/101029 | | 8/2009 |
| WO | WO2013/010815 | A1 | 1/2013 |

* cited by examiner

PAPER-BASED OR PAPERBOARD-BASED CONTAINER AND RELATED METHODS

FIELD OF THE INVENTION

The present invention relates to a container for holding a pourable food product, comprising a paper-based or paperboard-based laminate sheet material. In particular, the invention relates to such a container comprising an opening device or closure for dispensing and/or accessing the food product. The invention also relates to methods for producing such a container and to a container pre-cursors for such a container.

BACKGROUND

Within the art of paperboard-based packaging, it is known to produce a blank and fold and assemble the blank to produce a container. The container may then be utilised to hold a pourable food product, e.g. a liquid, e.g. dairy products, such as milk or yoghurt, or juices.

The blank is typically produced from a laminate packaging material, which typically comprises a multi-ply paperboard sheet on which is laminated one or a plurality of barrier layers for holding the food product and/or prevent migration of air and flavours through the paperboard. A barrier layer may typically comprise a polyethylene or an aluminium layer.

A method of producing the blank from the laminate packaging material typically comprises the steps of cutting the laminate packaging material to a predefined shape, and a method of producing the container from the blank typically comprises the step of folding the blank along predefined folding lines to produce the container.

The blank may be provided with crease lines in the laminate packaging material to aid folding of the blank along the folding lines. A crease line, or crease, may be defined as an embossed or impressed depression on one side of the laminate packaging material with a corresponding raised ridge or welt, also referred to as the bead, on the other side forming a line along which the laminate packaging material is structurally weakened and along which the laminate packaging material will bend or fold when pressure is applied.

Blanks may be produced in a converting process in which the blanks are cut from a web made from the laminate material having substantially parallel and rectilinear lateral boundary edges. The converting process typically comprises feeding the web of laminate material through one or a plurality of nips formed between a pair of cutting and/or creasing rollers to produce the blanks cut from the web and formed with creases lines for subsequent folding and/or with cuts and/or with holes, e.g. for fitting a closure to the blank material when a container is produced therefrom.

The layout of the blank patter on the web is known as a "nesting pattern". A nesting pattern is not a physical pattern that is visible on the web but a pattern that illustrates how the blanks are intended to be cut from the web and/or how the blanks are impressed. In other words, the nesting pattern illustrates the layout of the blanks on the web and, consequently, how the available web material is utilised.

The container may be provided with an opening device or closure allowing a consumer to open the container to access the food product. The opening device may be reclosable allowing the consumer to reclose the container, sealingly or non-sealingly, once the container has been opened. Alternatively, the opening device may not be reclosed once opened.

A commonly used opening devices comprise a patch defined by a small sheet of heat-seal plastic material which is heat sealed to the inside surface of a packaging material covering a hole in the packaging material; and a pull-off tab applied to the opposite side of the packaging material and heat sealed to the patch. The tab and patch adhere to each other, so that, when the tab is pulled off, the portion of the patch heat sealed to it is also removed to uncover the hole. This configuration is sometime referred to as a pre-laminated hole (PLH). Whereas this configuration may provide an acceptable opening device, there is a general need to improve upon known opening devices or closures, especially with the aim of providing a more enjoyable drinking experience when drinking directly from the container.

Within the art of paperboard-based containers, there is known to provide an extended top panel area of the container by folding down a top-fin onto the top panel at an off-centre position. The extended top panel area thus obtained can be used to provide the container with an enlarged opening device or closure. Such containers are known, for example, from EP2392517A1 and U.S. Pat. No. 20,190,106,239A1. Although positioned of-centre, the folded-down top-fin extending across the top panel will still restrict usage of the top panel.

U.S. Pat. No. 6,182,887B1 shows a container having an extended top panel produced by sealing the top panel and a rear wall of the container to one another at a sealing region that is coextensive with a top fin. Consequently, the top fin extends from the top panel in the plane of the rear wall, thus making essentially the whole top panel available for usage, e.g. positioning of an opening device or closure. However, the extending top-fin may still restrict access to the top panel. For example, a top-fin extending from the top panel in the plane of the rear wall may make it difficult for a consumer to drink directly from the container.

SUMMARY OF THE INVENTION

With the abovementioned challenges and known solutions in mind, and according to a first example aspect, the present disclosure provides a paper-based or paperboard-based container for holding a pourable food product, comprising:

- a planar or substantially planar bottom portion;
- a top portion arranged opposite the bottom portion and comprising a top panel and a top sealing region forming a top seal of the container; and
- a wall portion extending between the bottom portion and the top portion and comprising a plurality of wall sections bordering the top panel and a longitudinal sealing band extending between the bottom portion and the top portion over at least one of the wall sections,
- the top sealing region being folded onto said at least one of the wall sections comprising the longitudinal sealing band and being attached thereto.

Consequently, instead of the top sealing region, or top-fin, being folded onto and attached to the top panel of the container, as is common in prior art containers, the top-fin, or top sealing region, is folded onto the wall portion comprising the longitudinal sealing band, i.e. the longitudinal seam running from the bottom to the top of the container. This leaves the top panel free or substantially free from sealing structures since the section of the longitudinal sealing band extending into the top sealing region will also be folded onto the wall portion and, consequently, will not extend onto the top panel. Such sealing structures may comprise permanently sealing structures such as welded, glued or otherwise permanently joined seams where panels of the laminate sheet material are permanently joined to each other. This allows the top panel to be utilised in an efficient manner. For example, an opening device or a top closure can be positioned anywhere on the top panel since there will be no sealing structure to consider. Also, folding the top sealing region down onto the side wall portion comprising the longitudinal sealing band and attaching the sealing region thereto will give a consumer unrestricted access to the opening device or closure for accessing or dispensing the food product in an easy manner.

The container may advantageously comprise gusset panels which are folded onto each other underneath the top panel when the container is formed, allowing the top sealing region, in its entirety, to be folded down onto and attached to the wall section(s) comprising the longitudinal sealing band. In other words, the entire top sealing region may advantageously be folded onto said at least one of the wall sections comprising the longitudinal sealing band and attached thereto. The top sealing region may typically be formed by a top sealing band, and the whole top sealing band may be folded down onto and attached to the wall section(s) comprising the longitudinal sealing band.

The container may comprise an opening device or a closure being arranged in the top panel for dispensing and/or allowing access to the food product. The opening device may be reclosable, allowing the container to be reclosed after a first opening.

The container may be made from a paper-based or paperboard-based laminate sheet material comprising a multi-ply paperboard sheet on which is laminated one or a plurality of barrier layers for holding the food product and/or prevent migration of air and flavours through the paperboard sheet.

The top sealing region may be planar or substantially planar and arranged parallel or substantially parallel to said at least one of the wall sections comprising the longitudinal sealing band.

The top panel and the top sealing region may share a common border forming a top edge of the container.

The top edge may be rectilinear or substantially rectilinear and arranged parallel or substantially parallel to the bottom portion.

An opening device or a closure may be arranged in the top panel for dispensing and/or accessing the food product. The opening device or closure, in contrast to the above-mentioned sealing structures, including the top sealing region and the longitudinal sealing band, is not arranged to permanently seal the container but may be opened by a consumer to allow the consumer to dispense or access the food product.

The opening device or closure may comprise an opening being arranged adjacent said top edge.

The opening may be arranged at an orthogonal distance of between 1 mm to 10 mm from the top edge.

The top panel may be planar or substantially planar. The wall section or wall sections comprising the longitudinal sealing band may also be planar or substantially planar and the top panel may form an angle to said wall section or wall sections that is of any one of: within the range of 10 degrees to 90 degrees; within the range of 30 degrees to 80 degrees, within the range of 45 degrees to 75 degrees; and 60 degrees.

The top sealing region may comprise a plurality of sealed sealing band panels, all of which may be arranged parallel or substantially parallel and/or coplanar or substantially coplanar in the container.

The sealing band panels may comprise a central sealing band panel extending over the wall section or the wall sections comprising the longitudinal sealing band and having a longitudinal extent being any one of: at least 15 mm, at least 20 mm and at least 30 mm.

According to a second example aspect, the present disclosure provides a paper-based or paperboard-based sleeve for producing the container according to the first example aspect.

According to a third example aspect, the present disclosure provides a paper-based or paperboard-based blank for producing the sleeve according to the second example aspect.

The blank may be mirror-symmetric about a longitudinal central axis of the blank.

The blank may comprise first and second rectilinear or substantially rectilinear and parallel or substantially parallel boundary edges forming lateral or longitudinal boundary edges of the blank. The blank may also comprise a third rectilinear or substantially rectilinear boundary edge extending orthogonally or substantially orthogonally between the lateral boundary edges and forming a bottom boundary edge of the blank. Further, the blank may comprise a fourth, non-rectilinear boundary edge extending between the lateral boundary edges and forming a top boundary edge of the blank.

The blank may comprise a top region having a top crease line pattern and being configured to form said top portion of the container. The top region may comprise a top panel and gusset panels configured to be folded onto each other underneath the top panel when a container is formed from the blank.

The top boundary edge may be mirror-symmetric about a longitudinal central axis of the blank.

The top boundary edge may comprise a plurality of individually rectilinear top boundary edge sections.

According to a fourth example aspect, the present disclosure provides a method of producing a paper-based or paperboard-based container for holding a pourable food product comprising the steps of:

- sealing a paper-based or paperboard-based laminate sheet material along a longitudinal sealing band forming a tubular proto-container;
- top-sealing the proto-container at a top sealing region; and
- folding the top sealing region onto at least one wall section of the proto-container comprising said longitudinal sealing band and attaching the top sealing region to said at least one wall section.

The method may comprise forming a top portion of the container by folding gusset panels of the laminate sheet material onto each other underneath a top panel of the laminate sheet material. The method may further comprises arranging an opening device or a closure for dispensing or accessing the food product in the top portion. The opening device may be reclosable, thus allowing the container to be reclosed after a first opening.

The method may comprise the steps of:

- bottom-sealing the laminate sheet material to form a bottom-sealed and open-top proto-container; and
- filling the bottom-sealed and open-top proto-container with the pourable food product,
- wherein said step of top-sealing the laminate sheet material is performed after said step of filling the bottom-sealed and open-top proto-container with the pourable food product. In other words, the method may comprise filling the proto-container from the top-side.

Alternatively, the step of top-sealing the proto-container at a top sealing region may produce a top-sealed but open-bottom proto-container, and the method may comprise the steps of:

filling the top-sealed and open-bottom proto-container with the pourable food product; and bottom-sealing the laminate sheet material.

Consequently, instead of filling the proto-container from the top-side, the method may comprise filling the proto-container from the bottom-side.

The method may comprise a step of providing the top panel of the container free from sealing structures. Such sealing structures may comprise permanently sealing structures such as welded, glued or otherwise permanently joined seams where panels of the laminate sheet material are permanently joined to each other.

The method may comprise arranging the top sealing region planar or substantially planar and parallel or substantially parallel to said at least one of the wall sections comprising the longitudinal sealing band.

The method may comprise arranging the top panel and the top sealing region such that they share a common border forming a top edge of the container.

The method may comprise a step of arranging the top edge rectilinear or substantially rectilinear and the step of arranging the top edge parallel or substantially parallel to a planar or substantially planar bottom portion of the container.

The method may comprise a step of arranging the opening device or a closure for dispensing or accessing the food product in the top panel of the container.

The method may comprise a step of arranging an opening of the opening device or closure adjacent said top edge forming a border between the top panel and the top sealing region.

The method may comprise a step of arranging the opening at an orthogonal distance of between 1 mm to 10 mm from the top edge.

The method may comprise a step of arranging the top panel planar or substantially planar. The method may also comprise a step of arranging the wall section or wall sections comprising the longitudinal sealing band planar or substantially planar, and a step of arranging the top panel at an angle to said wall section or wall sections that is of any one of:

within the range of 10 degrees to 90 degrees; within the range of 30 degrees to 80 degrees, within the range of 45 degrees to 75 degrees; and 60 degrees.

The step of top-sealing the proto-container at the top sealing region may comprise a sub-step of sealing a plurality of sealing band panels to each other. This sub-step may comprise arranging the sealed sealing band panels parallel or substantially parallel and/or coplanar or substantially coplanar in the container. This sub-step may comprise arranging a central sealing band panel of said sealing band panels such that it extends over the wall section or the wall sections comprising the longitudinal sealing band and has a longitudinal extent being any one of: at least 15 mm, at least 20 mm and at least 30 mm.

According to a fifth example aspect, the present disclosure provides a container for holding a pourable food product comprising a paper-based or paperboard-based laminate sheet material forming:

a substantially planar bottom portion;

a top portion arranged opposite the bottom portion and comprising a top panel and a top sealing region forming a top seal of the container; and a wall portion extending between the bottom portion and the top portion and comprising a plurality of wall sections bordering the top panel and a longitudinal sealing band extending between the bottom portion and the top portion over at least one of the wall sections.

The container may comprise a barrier arranged in the top panel for providing a seal in an opening in the top panel, and an opening device or closure being arranged for breaking the seal during a first opening of the container and dispensing and/or accessing the food product. The top sealing region is folded onto at least one of the wall sections and is attached thereto.

The opening device or closure may comprise:

a first sheet which extends over at least a part section of the top panel and is attached thereto, which first sheet comprises a through-opening that is aligned with the barrier; and;

a second sheet which is releasably attached to at least a part section of the first sheet at an outside surface thereof, which second sheet is attached to the barrier via the through-opening prior to the first opening, and which second sheet is configured to tear open the barrier during the first opening.

The second sheet may be manually operable from a closed position, in which the second sheet covers the through-opening, to an open position, in which the second sheet exposes the through-opening and allows the pourable food product to be dispensed through or accessed via the through-opening.

Consequently, instead of top sealing region being folded onto the top panel of the container, or extending from the top panel forming a top-fin, as is the case in prior art containers, the present top sealing region is, in its entirety, folded down onto one or a plurality of the wall portion. This leaves the top panel free from top sealing structures and allows for free positioning of the dispenser seal structure and the opening device or closure. Also, since the section of the longitudinal sealing band extending into the top sealing region will also be folded onto the wall portion or portions, the longitudinal sealing band will also not extend onto the top panel.

After the first opening, the second sheet may be manually operable from the open position to the closed position to reclose the through-opening.

The first sheet may extend over at least a part section of the top sealing region and be attached thereto.

The first sheet may comprise a drinking surface extending from the through-opening to a distance from the through-opening of any one of: at least at 20 mm; at least 25 mm; and at least 30 mm. The drinking surface may into over the top sealing region.

The top panel and the top sealing region may share a common border which forms an uppermost border of the top panel and a top edge of the container, and the first sheet may extend over said top edge.

The through-opening may be positioned within 2-10 mm from said uppermost border of the top panel.

The first sheet and the second sheet may each comprise a first transversal edge positioned at or adjacent a lowermost border of the top panel.

The first sheet may comprise a second transversal edge which is positioned at or adjacent a lowermost border of the top sealing region.

An outside surface of the first sheet and/or an inside surface of the second sheet may comprise an adhesive. The inside surface of the second sheet may comprise, in a region facing the through-opening when the second sheet is in the closed position, a region of reduced adhesiveness.

The barrier may comprise any one of:

a pre-laminated hole; and;

a removable section of the laminate sheet material of the top panel being delimited by a cut made partially through the top panel from an outside surface thereof, the cut leaving one or a plurality of inner layers of the laminated sheet material intact to provide said prior to the first opening.

According to a sixth example aspect, the present disclosure provides a method of producing paper or paperboard-based blanks for producing a container for holding a pourable food product, each blank comprising:

first and second substantially rectilinear boundary edges, each extending substantially parallel to a first, longitudinal direction of the blank between first and second endpoints;

a third boundary edge extending substantially parallel to a second, transversal direction of the blank between the first endpoint of the first boundary edge and the first endpoint of the second boundary edge;

a fourth, non-rectilinear boundary edge extending between the second endpoint of the first boundary edge and the second endpoint of the second boundary edge.

wherein the method comprises the steps of:

laying out, on a web of laminate material, a first row and a second row of blank patterns, each row comprising a plurality of blank patterns arranged side by side with the first boundary edge of one blank pattern adjoining the second boundary edge of a neighbouring blank pattern, and the fourth boundary edge of the blank patterns of the first row adjoining the fourth boundary edge of the blank patterns of the second row; and cutting the web along the laid out first, second, third and fourth boundary edges to form said blanks.

According to a seventh example aspect, the present disclosure provides a nesting pattern for producing paper or paperboard-based blanks from a web of laminate material, each blank comprising:

first and second substantially rectilinear boundary edges, each extending substantially parallel to a first, longitudinal direction of the blank between first and second endpoints;

a third boundary edge extending substantially parallel to a second, transversal direction of the blank between the first endpoint of the first boundary edge and the first endpoint of the second boundary edge;

a fourth, non-rectilinear boundary edge extending between the second endpoint of the first boundary edge and the second endpoint of the second boundary edge.

The nesting pattern comprises a first row and a second row of blank patterns arranged side by side with the first boundary edge of one blank pattern adjoining the second boundary edge of a neighbouring blank pattern, and the fourth boundary edge of the blank patterns of the first row adjoining the fourth boundary edge of the blank patterns of the second row.

The fourth boundary edges may form a non-rectilinear line displaying a two-fold rotational symmetry with respect to a centre located on said line.

Above-discussed preferred and/or optional features of each aspect of the invention may be used, alone or in appropriate combination, in the other aspects of the invention.

DESCRIPTION OF THE DRAWINGS

Following drawings are appended to facilitate the understanding of the invention.

Figure 1:
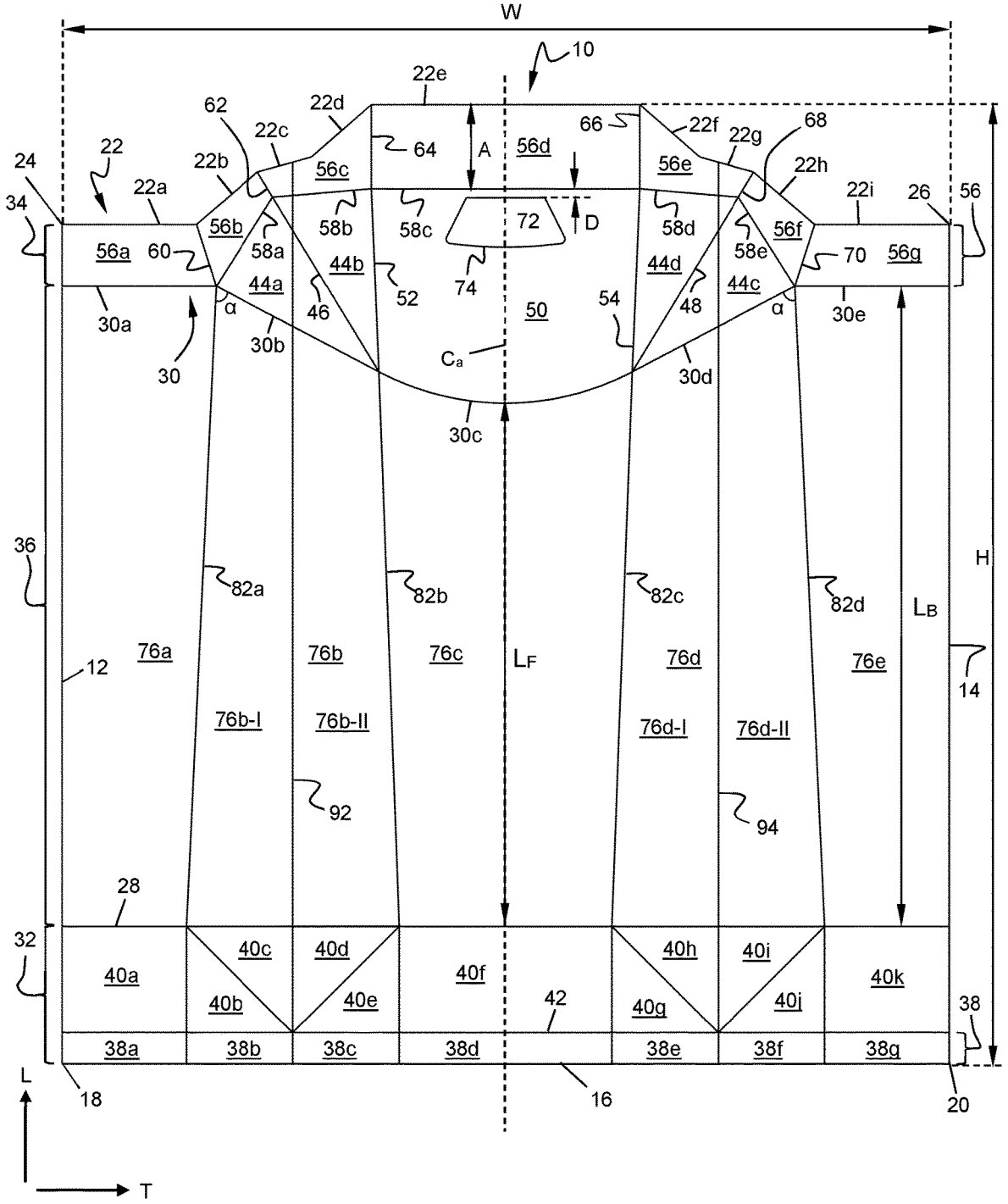
FIG. 1 show an embodiment of a blank.

It should be understood that the drawings are not intended to limit the invention to the subject-matter depicted in the drawings.

In the drawings, like reference numerals have been used to indicate common parts, elements or features unless otherwise explicitly stated or implicitly understood by the context.

DETAILED DESCRIPTION

In the following, specific embodiments of a blank and a container produced therefrom will be described in more detail with reference to the drawings. However, it is specifically intended that the invention as defined in the following claims is not limited to the embodiments and illustrations contained herein but includes modified forms of the embodiments including portions of the embodiments and combinations of elements of different embodiments as come within the scope of the claims.

FIG. 1 shows a first embodiment of a blank 10 for producing a sleeve and, subsequently, a container for holding a pourable food product.

The blank 10 can comprise several layers of different materials, for example paper, paperboard, plastic or metal, in particular aluminium. Typically, the blank 10 may be made from a paper-based or paperboard-based laminate sheet material comprising a multi-ply paperboard sheet on which is laminated one or a plurality of barrier layers for holding the food product and/or prevent migration of air and flavours through the paperboard sheet.

The blank 10 has several crease or fold lines which are intended to facilitate the folding of the blank 10 when produced to form a container and which divide the blank 10 into several regions and sub-regions.

The blank 10 comprises rectilinear or substantially rectilinear first 12 and second 14 boundary edges which are parallel or substantially parallel to a longitudinal direction L of the blank 10. The boundary edges 12 and 14 are parallel or substantially parallel, of equal or substantially equal length and form lateral boundary edges of the blank 10.

A central axis $C_a$ of the blank 10 extends parallel to the longitudinal direction L equidistant from the lateral boundary edges 12 and 14.

The blank 10 also comprises a rectilinear or substantially rectilinear third boundary edge 16 which is parallel or substantially parallel to a transversal direction T of the blank 10 extending perpendicular to the longitudinal direction L. The boundary edge 16 extends between first, bottom endpoints 18, 20 of the lateral boundary edges 12, 14 and forms a bottom boundary edge of the blank 10.

The blank 10 further comprises a fourth boundary edge 22 extending between second, top endpoints 24, 26 of the lateral boundary edges 12, 14 and forming a top boundary edge of the blank 10.

The bottom endpoints 18 and 20 form bottom corner points of the blank 10 and the top endpoints 24 and 26 form top corner points. Since the lateral boundary edges 12 and 14 are parallel or substantially parallel, and since the bottom boundary edge 16 is perpendicular or substantially perpendicular to the lateral boundary edges 12, 14, the corner points 18, 20, 24, 26 define a rectangular or substantially rectangular shape. In contrast to the bottom boundary edge 16, however, the top boundary edge 22 is non-rectilinear and extend beyond the rectangular shape defined by the corner points 18, 20, 24, 26.

The top boundary edge 22 comprises a plurality of individually rectilinear or substantially rectilinear sections 22*a*-22*i*.

The top boundary edge sections 22*a* and 22*i* are colinear or substantially colinear and extend, starting from the top corner points 24 and 26, respectively, parallel or substantially parallel to the transversal direction T, i.e. parallel or substantially parallel to the bottom boundary edge 16. The edge sections 22*a* and 22*i* are of equal or substantially equal length. The edge sections 22*b* and 22*h* extend from edges sections 22*a* and 22*i*, respectively, and angle away from the bottom boundary edge 16. The edge sections 22*b* and 22*h* form an angle of approximately 45 degrees to the transversal direction T. The edge sections 22*c* and 22*g* extend from edges sections 22*b* and 22*i*, respectively, and form an angle of approximately 20 degrees to the transversal direction T. The edge sections 22*d* and 22*f* extend from edges sections 22*c* and 22*g*, respectively, and form an angle of approximately 45 degrees to the transversal direction T. The edge section 22*e*, finally, extends between edge sections 22*d* and 22*f* parallel or substantially parallel to the transversal direction T, i.e. parallel or substantially parallel to the bottom boundary edge 16. However, due to the inclined orientations of edge sections 22*b*-22*d* and 22*f*-22*h*, edge section 22*e* is arranged further from the bottom boundary edge 16 than are the edge sections 22*a* and 22*i*.

The top boundary edge 22 is reflection-symmetric about the central axis $C_a$. In other words, using the central axis $C_a$ as an axis of symmetry, the sections of the top boundary edge 22 located on one side of the central axis $C_a$ is mirrored by the corresponding sections located on the other side. Consequently, edge sections 22*a*, 22*b*, 22*c* and 22*d* are mirrored by edge sections 22*i*, 22*h*, 22*g* and 22*f*, respectively, and the central axis $C_a$ run centrally through the edge section 22*e*.

The blank 10 comprises first 28 and second 30 crease lines, each extending across the blank 10, i.e. between the lateral boundary edges 12, 14. The crease lines 28 and 30 divide the blank 10 into:

- a bottom region 32 having a bottom crease line pattern and being configured to form a bottom portion of the container formed from the blank 10;
- a top region 34 having a top crease line pattern and being configured to form a top portion of the container; and
- an intermediate region 36 contained between said first 28 and second 30 crease lines, interposed between the bottom region 32 and the top region 34 and being configured to form an intermediate, wall portion of the container.

The crease line 28 is rectilinear or substantially rectilinear and extends parallel or substantially parallel to the transversal direction T across the panel 10.

Partitioned from the intermediate region 36 by crease line 28, the bottom region 32 comprises a plurality of rectangular or substantially rectangular bottom panels 40*a*, 40*f* and 40*k* and a plurality of triangular or substantially triangular gusset panels 40*b*-40*e* and 40*g*-40*j*. The gusset panels 40*b*-40*e* and 40*g*-40*j* are arranged in two rectangular or substantially rectangular sub-regions arranged in file with the bottom panels 40*a*, 40*f* and 40*k*. When a container is produced from the blank 10, the bottom and gusset panels 40*a*-40*k* are configured to be folded to form a substantially planar bottom of the container in a manner which is, as such, known in the art.

The bottom region 32 also comprises a plurality of rectangular or substantially rectangular bottom sealing band panels 38*a*-38*g* extending between the lateral boundary edges 12, 14. The sealing band panels 38*a*-38*g* are partitioned, in the transversal direction T, by longitudinal or substantially longitudinal crease lines. The sealing band panels 38*a*-38*g* form a bottom sealing band 38 that extends along the bottom boundary edge 16 and is partitioned from the bottom and gusset panels 40*a*-40*k* by a rectilinear or substantially rectilinear crease line 42 extending across the blank 10 parallel or substantially parallel to the transversal direction T. When a container is produced from the blank 10, the sealing band panels 38*a*-38*g* are configured to be sealed to each other to form a bottom seal of the container in a manner which is, as such, known in the art.

Turning now to the top region 34 of the blank 10, the crease line 30 comprises a plurality of crease line sections 30*a*-30*e*, of which crease line sections 30*a*, 30*b*, 20*d* and 30*e* are individually rectilinear or substantially rectilinear and crease line section 30*c* is curvilinear. The crease line sections 30*a* and 30*e* are colinear or substantially colinear and extend, starting from lateral boundary edges 12 and 14, respectively, parallel or substantially parallel to the transversal direction T, i.e. parallel or substantially parallel to the edge sections 22*a* and 22*i*. The crease line sections 30*a* and 30*e* are of equal or substantially equal length. The crease line sections 30*b* and 30*d* extend from crease line sections 30*a* and 30*e*, respectively, and angle towards the bottom boundary edge 16. The crease line sections 30*b* and 30*d* form an angle of approximately 30 degrees to the transversal direction T. Crease line sections 30*b* and 30*d* are of equal or substantially equal length. Finally, crease line section 30*c* extends between crease line sections 30*b* and 30*d* and has a convex side facing the intermediate region 36.

Similar to the top boundary edge 22, the crease line 30 is reflection-symmetric about the central axis $C_a$. In other words, using the central axis $C_a$ as an axis of symmetry, the sections of the crease line 30 located on one side of the central axis $C_a$ is mirrored by the corresponding sections located on the other side. Consequently, crease line sections 30*a* and 30*b* are mirrored by crease line sections 30*e* and 30*d*, respectively, and the central axis $C_a$ run centrally through the crease line section 30*c*.

Partitioned from the intermediate region 36 by crease line 30, the top region 34 comprises triangular or substantially triangular gusset panels 44*a* and 44*b* arranged on one side of the central axis $C_a$ and corresponding triangular or substantially triangular gusset panels 44*c* and 44*d*, partitioned by a rectilinear or substantially rectilinear crease line 48, arranged on the other side. The gusset panels 44*a* and 44*b* are partitioned by a rectilinear or substantially rectilinear crease line 46. The gusset panels 44*c* and 44*d* are partitioned by a rectilinear or substantially rectilinear crease line 48. Crease line 46 connects to crease line 30 at the intersection of crease line sections 30*b* and 30*c*, and crease line 48 connects to crease line 30 at the intersection of crease line sections 30*d* and 30*e*. Gusset panels 44*a* and 44*b* are equilateral and configured to be folded onto each other when the blank 10 is folded to form the container. Consequently, gusset panels 44*a* and 44*b* are reflection-symmetric with respect to crease line 46, i.e. using crease line 46 as an axis of symmetry. Likewise, gusset panels 44*c* and 44*d* are equilateral and reflection-symmetric with respect to crease line 48, thus allowing gusset panels 44*c* and 44*d* to be folded onto each other when the container is formed.

Gusset panels 44*a* and 44*c* are partitioned from the intermediate region 36 by crease line sections 30*b* and 30*e*, respectively.

The top region 34 also comprises a top panel 50 arranged between gusset panels 44*b* and 44*d*. Top panel 50 is partitioned from gusset panel 44*b* by a rectilinear or substantially rectilinear crease line 52 and from gusset panel 44*d* by a rectilinear or substantially rectilinear crease line 54. Crease line 52 connects to crease line 30 at the intersection of crease line sections 30*b* and 30*c*, and crease line 54 connects to crease line 30 at the intersection of crease line sections 30*d* and 30*e*. Crease lines 52 and 54 are not perfectly parallel to the central axis $C_a$ but converge slightly when moving along the crease lines 52 and 54 towards the intermediate region 36. Crease lines 52 and 54 form an angle to the central axis $C_a$ of approximately 3 degrees.

The top panel 50 is partitioned from the intermediate region 36 by crease line 30*c*. Consequently, the bottom boundary of the top panel 50, i.e. the boundary of the top panel 50 facing the intermediate region 36, is convex.

The gusset panels 44*a*-44*d* and the top panel 50 are arranged reflection-symmetric or substantially reflection-symmetric about the central axis $C_a$. In other words, using the central axis $C_a$ as an axis of symmetry, gusset panels 44*a* and 44*b* are mirrored by gusset panels 44*c* and 44*d*, respectively, and the central axis $C_a$ runs centrally through the top panel 50.

The top region 34 further comprises top sealing band panels 56*a*-56*g* forming a top sealing band 56 extending along the top boundary edge 22 of the blank 10. When a container is formed from the blank 10, the top sealing band panels 56*a*-56*g* are configured to be sealed to each other to form a top seal of the container, as will be discussed in more detail later in the disclosure.

Sealing band panel 56*a* extends from lateral boundary edge 12 and runs between crease line section 30*a* and boundary edge section 22*a*. In a corresponding manner, sealing band panel 56*g* extends from lateral boundary edge 14 and runs between crease line section 30*e* and boundary edge section 22*i*.

Sealing band panel 56*b* extends from sealing band panel 56*a* and runs between gusset panel 44*a* and boundary edge section 22*b*. In a corresponding manner, sealing band panel 56*f* extends from sealing band panel 56*g* and runs between gusset panel 44*c* and boundary edge section 22*h*. Sealing band panel 56*b* is partitioned from gusset panel 44*a* by a rectilinear or substantially rectilinear crease line section 58*a* and from the neighbouring sealing band panel 56*a* by a rectilinear or substantially rectilinear crease line 60. Crease line 60 extends between the intersection of boundary edge sections 22*a* and 22*b* and the intersection of crease line sections 30*a* and 30*b*. Crease line 60 forms an angle of approximately 15 degrees to the longitudinal direction L. Crease line section 58*a* forms an angle of approximately 30 degrees to the longitudinal direction L. Sealing band panel 56*f* is partitioned from gusset panel 44*c* by a rectilinear or substantially rectilinear crease line section 58*e* and from the neighbouring sealing band panel 56*g* by a rectilinear or substantially rectilinear crease line 70. Crease line 70 extends between the intersection of boundary edge sections 22*i* and 22*h* and the intersection of crease line sections 30*e* and 30*d*. As crease line 60, crease line 70 forms an angle of approximately 15 degrees to the longitudinal direction L but angled in the opposite direction as compared to crease line 60. Crease line section 58*e* forms an angle of approximately 30 degrees to the longitudinal direction L but angled in the opposite direction as compared to crease line section 58*a*.

Sealing band panel 56*c* extends from sealing band panel 56*b* and runs between gusset panel 44*b* and the combined extent of boundary edge sections 22*c* and 22*d*. In a corresponding manner, sealing band panel 56*e* extends from sealing band panel 56*f* and runs between gusset panel 44*d* and the combined extent of boundary edge sections 22*g* and 22*f*. Sealing band panel 56*c* is partitioned from gusset panel 44*b* by a rectilinear or substantially rectilinear crease line section 58*b* and from the neighbouring sealing band panel 56*b* by a rectilinear or substantially rectilinear crease line 62. Crease line 62 extends between the intersection of boundary edge sections 22*b* and 22*c* and the intersection of crease line sections 58*a* and 58*b*. Crease lines 62 and 46 are collinear or substantially collinear and form an angle of approximately 25 degrees to the longitudinal direction L. Crease line section 58*b* forms an angle of approximately 85 degrees to the longitudinal direction L. Sealing band panel 56*e* is partitioned from gusset panel 44*d* by a rectilinear or substantially rectilinear crease line section 58*d* and from the neighbouring sealing band panel 56*f* by a rectilinear or substantially rectilinear crease line 68. Crease line 68 extends between the intersection of boundary edge sections 22*h* and 22*g* and the intersection of crease line sections 58*e* and 58*d*. Crease lines 68 and 48 are collinear or substantially collinear and form an angle of approximately 25 degrees to the longitudinal direction L but angled in the opposite direction as compared to crease lines 62 and 46. Crease line section 58*d* forms an angle of approximately 85 degrees to the longitudinal direction L but angled in the opposite direction as compared to crease line section 58*b*.

Finally, sealing band panel 56*d* extends between sealing band panels 56*c* and 56*e* and runs between top panel 50 and boundary edge section 22*e*. Sealing band panel 56*d* is partitioned from top panel 50 by a rectilinear or substantially rectilinear crease line section 58*c* and from the neighbouring sealing band panels 56*c* and 56*e* by rectilinear or substantially rectilinear crease lines 64 and 66, respectively. Crease line 64 is parallel or substantially parallel to the longitudinal direction L and extends between the intersection of boundary edge sections 22*d* and 22*e* and the intersection of crease line sections 58*b* and 58*c*. Crease line 66 is also parallel or substantially parallel to the longitudinal direction L but extends between the intersection of boundary edge sections 22*f* and 22*e* and the intersection of crease line sections 58*d* and 58*c*. Crease line section 58*c* and boundary edge section 22*e* are parallel or substantially parallel.

The sealing band 56 is reflection-symmetric about the central axis $C_a$. In other words, using the central axis $C_a$ as an axis of symmetry, sealing band panels 56*a*, 56*b*, 56*c* are mirrored by sealing band panels 56*g*, 56*f*, 56*e*, respectively, and the central axis $C_a$ runs centrally through sealing band panel 56*d*.

The top panel 50 comprises a removable section 72 delimited by a loop of weakness 74 allowing section 72 to be removed from the container formed from the blank 10 when the container is initially opened. This opening action will be discussed in more detail later in the disclosure. The loop of weakness 74 may, for example, be a so-called "half-cut", i.e. a cut made partially through the laminated substrate of the blank 10 from the outside surface thereof leaving one or a plurality of inner layers of the laminated substrate intact to provide, prior to a first opening of the container produced from the blank 10, an uninterrupted barrier against a food product to be contained in the container.

Turning now to the intermediate region 36 of the blank 10, this region comprises panels 76*a*-76*e* partitioned by crease lines 82*a*-82*d*.

Panel 76*c* is configured to form a front wall panel of a container produced from the blank 10. Neighbouring panel 76*c*, the intermediate region 36 comprises panels 76*b* and 76*d* which are configured to form side wall panels of the produced container. The panel 76*c* is partitioned from the panel 76*d* by a rectilinear or substantially rectilinear crease line 82*c* and from panel 76*b* by a rectilinear or substantially rectilinear crease line 82*b*.

The intermediate region 36 further comprises panel 76*a* neighbouring panel 76*b* and a fifth panel 76*e* neighbouring panel 76*d*. Panels 76*a* and 76*e* are configured to form rear wall panel sections of the produced container. Panel 76*a* is partitioned from panel 76*b* by a rectilinear or substantially rectilinear crease line 82*a* and panel 76*e* is partitioned from panel 76*d* by a rectilinear or substantially rectilinear crease line 82*d*.

Crease line 82*c* extends between crease line 28 and the intersection of crease line sections 30*c* and 30*d*. Crease line 82*b* extends between crease line 28 and the intersection of crease line sections 30*b* and 30*c*. Starting from the top region 34 and moving towards the bottom region 32, crease lines 82*b* and 83*c* converge. Consequently, the width of panel 76*c*, i.e. the distance between the crease lines 76*c* and 76*d* in the traversal direction T, continuously decreases when moving from the top region 34 to the bottom region 32. Using the central axis $C_a$ as an axis of symmetry, crease line 82*b* is mirrored by crease line 82*c* and both crease lines 82*b* and 82*c* form an angle to the central axis $C_a$ of approximately 2 degrees, although diverging from the central axis $C_a$ in opposite directions.

Crease line 82*a* extends between crease line 28 and the intersection of crease line sections 30*a* and 30*b*. Starting from the top region 34 and moving towards the bottom region 32, crease lines 82*a* and 82*b* diverge. Consequently, the width of panel 76*b* increases continuously when moving from the top region 34 to the bottom region 32. Crease line 82*d* extends between crease line 28 and the intersection of crease line sections 30*d* and 30*e*. Starting from the top region 34 and moving towards the bottom region 32, crease lines 82*d* and 82*c* diverge. Consequently, similar to panel 76*b*, the width of panel 76*d* increases continuously when moving from the top region 34 to the bottom region 32. Crease lines 82*a* and 82*d* both form an angle to the central axis $C_a$ of approximately 3 degrees, although diverging from the central axis $C_a$ in opposite directions. Consequently, using the central axis $C_a$ as an axis of symmetry, panel 76*b* is mirrored by panel 76*d*.

The blank 10 also comprises two rectilinear or substantially rectilinear crease lines 92 and 94 extending over the whole length of the blank 10, i.e. between the bottom boundary edge 16 and the top boundary edge 22, parallel or substantially parallel to the central axis $C_a$. Crease lines 92 and 94 extend centrally or substantially centrally in panels 76*b* and 76*d*, respectively, and, consequently, divide panels 76*b* and 76*d* into two panel sections 76*b*-I, 76*b*-II and 76*d*-I, 76*d*-II, respectively. Also, in the bottom region 32, the crease lines 92 and 94 extend centrally or substantially centrally in the gusset panel sub-regions formed by gusset panels 40*b*-40*e* and 40*g*-40*j*, respectively.

Figure 2:
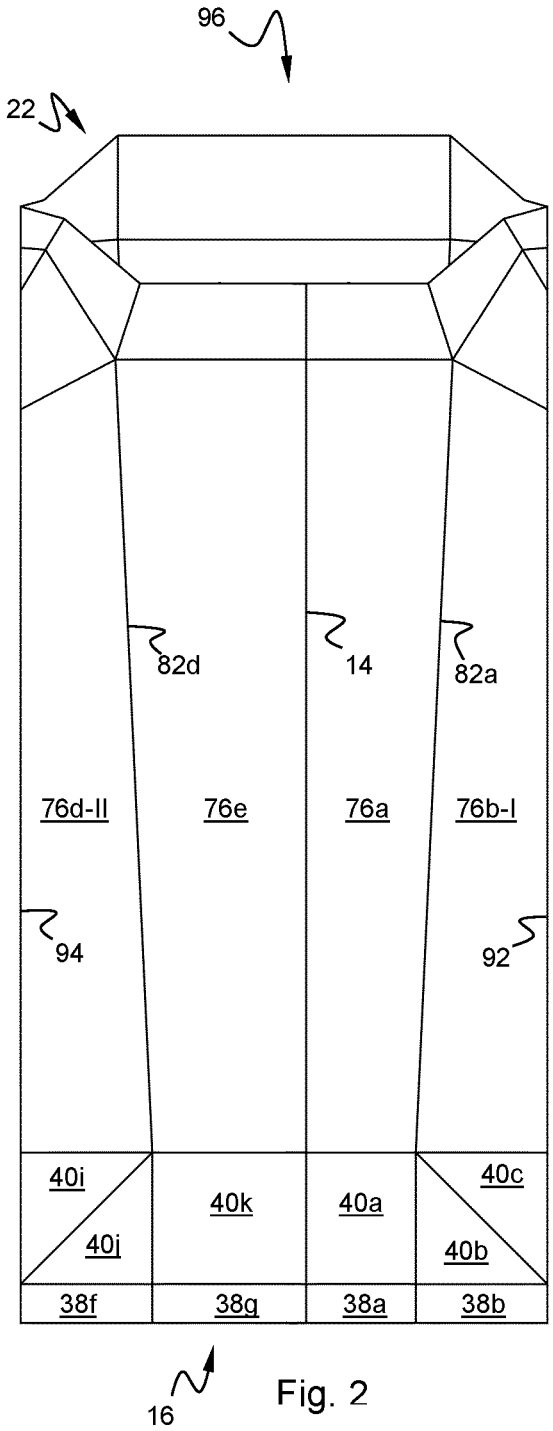
FIGS. 2 and 3 show the blank according to FIG. 1 folded and sealed to form a sleeve.
Figure 3:
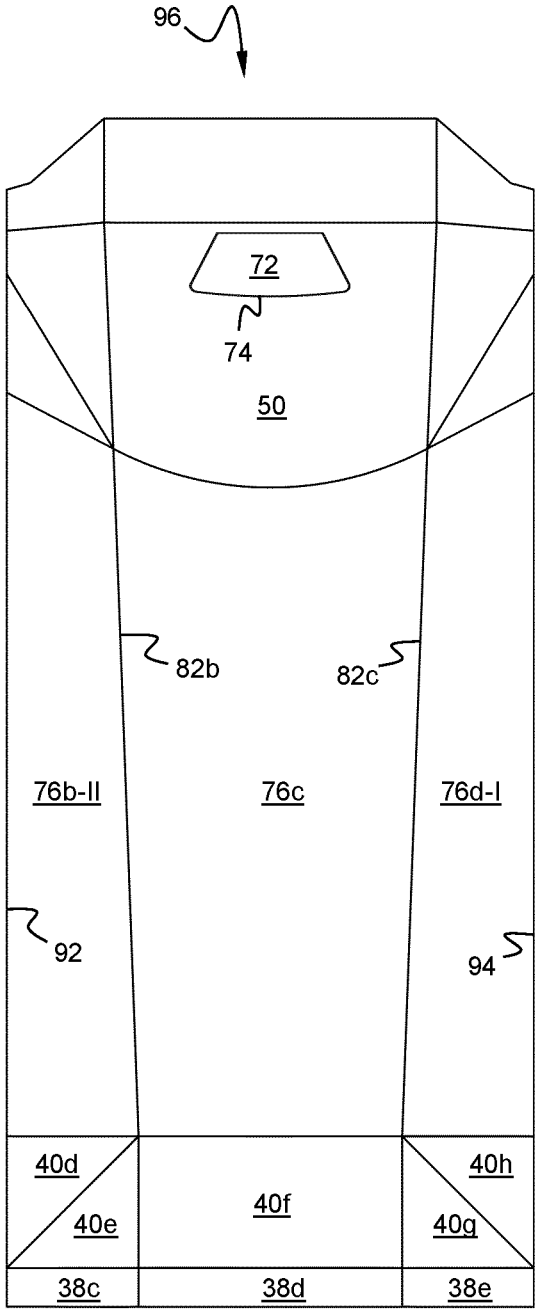

FIG. 2 shows a sleeve 96 produced from the blank 10 of FIG. 1 in a rear view and FIG. 3 shows the sleeve 96 in a front view. Features of the sleeve already described with reference to FIG. 1 are provided with corresponding reference numbers in FIGS. 2 and 3.

The sleeve 63 is created from the blank 10 by folding the blank 10 along the two crease lines 92 and 94, bringing panel 76*e* to overlap panel 76*a*. In the overlapping region, panels 76*a* and 76*e* are then sealed to one another, e.g. welded together, to form a longitudinal sealing band 14 forming a planar or substantially planar rear wall section. The sleeve 96 thus obtains a circumferential structure, closed in the circumferential direction, with an opening in the region of the bottom boundary edge 16 and with an opening in the region of the top boundary edge 22. The lateral boundary edge ending up inside the sleeve, i.e. boundary edge 12 in this case, is covered, either prior to folding the blank 10 along the crease lines 92 and 94 or after the overlapping regions of panels 76*a* and 76*e* have been connected to one another. The covering of the open cut edge of the composite material has the purpose of preventing any contact between the contents of the container and this layer, in particular the paper or paperboard layer contained therein. As is known in the art, the covering of the cut edge can be achieved by stripping composite layers from the edge and folding a remaining, impermeable layer over the edge. Alternatively, as is also known in the art, a strip of sealing material (not shown) can be applied over the lateral boundary edge ending up inside the sleeve.

In the front view (FIG. 3), panel 76*c* is visible as are panel sections 76*b*-II and 76*d*-I. The loop of weakness 74 encircling the removable section 72 of the top panel 50 is also visible in the front view. However, the loop of weakness is not visible in the rear view (FIG. 2) since the inside layer of the laminated material of the top panel 50 is unbroken, providing said uninterrupted barrier. In the rear view (FIG. 2), panels 76*a* and 76*e* are visible as are panel sections 76*b*-I and 76*d*-II.

Figure 4:
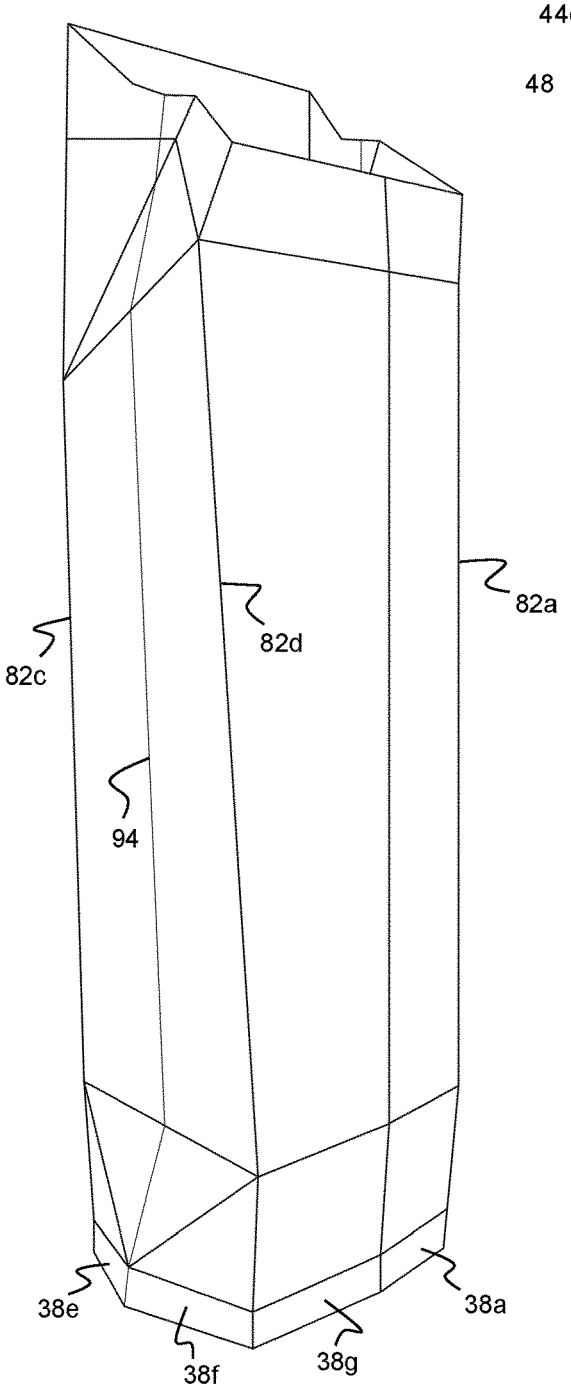
FIG. 4 is a perspective view of the sleeve according to FIGS. 2 and 3 after having been erected to tubular form.

FIG. 4 shows the sleeve 96 from FIGS. 2 and 3 in an erected state. The erected state is arrived at by reversing the previous folding along the crease lines 92 and 94 and folding the sleeve 96 back along the crease lines 92 and 94 by approximately 180 degrees. The folding back along the crease line 92 has the consequence that the two panel sections 76*b*-I and 76*b*-II no longer lie on top of one another but become arranged in the same or substantially the same plane. In a corresponding manner, the folding back along the crease line 94 has the consequence that the two panel sections 76*d*-I and 76*d*-II no longer lie on top of one another but become arranged in the same or substantially the same plane. The folding back action also involves folding the sleeve 96 along crease lines 82*a*, 82*b*, 82*c* and 82*d* by approximately 90 degrees, thus forming side edges of the container-to-be.

Next, the bottom region of the erected sleeve is folded and sealed. This involves bringing the bottom sealing band panels 38*f* and 38*b* into sealing engagement with sealing band panels 38*e* and 38*c*, respectively, and bringing bottom sealing band panels 38*g* and 38*s* into sealing engagement with sealing band panel 38*d*. The sealing engagement may be effectuated by welding in a manner which is, as such, known in the art. Folding and sealing the bottom region also involves folding gusset panels 40*j* and 40*g* inwards onto gusset panels 40*i* and 40*h*, respectively, and folding corresponding gusset panels 40*b* and 40*e* inwards onto gusset panels 40*d* and 40*c*, respectively. It further involves folding down the now sealed sealing band onto bottom panel 40*f* and gusset panels 40*e* and 40*g* and connecting the sealing band thereto, e.g. by welding, and, finally, folding in lugs formed by the previously folded gusset panels, thus arriving at the sealed and substantially planar configuration illustrated in FIG. 5. It is to be understood, however, that other configurations of a sealed and planar bottom region are known in the art and may be used instead of the one described above.

Figure 6:
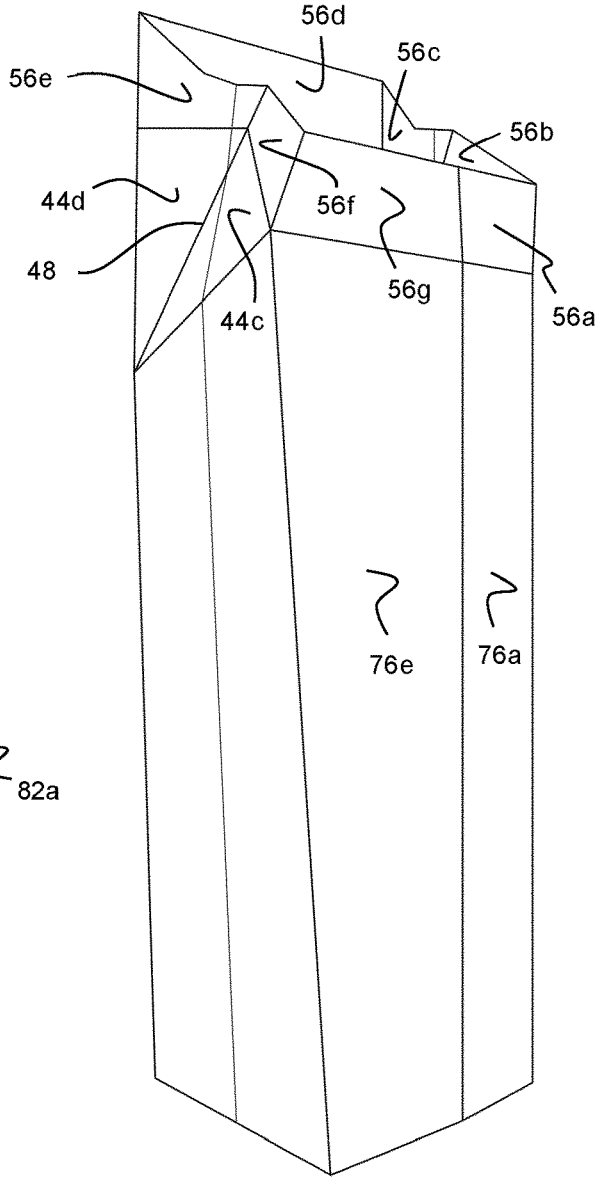
FIG. 6 is a perspective view of the sleeve according to FIG. 4 after having been bottom-sealed.

Erecting and bottom sealing the sleeve may be effectuated in a packaging machine (not shown), where the sleeve 96 may be supplied from a magazine and erected on a mandrel. The bottom region may be formed and sealed on the mandrel and the proto-container, i.e. the partially-formed container as shown in FIG. 6, may then be discharged from the mandrel to a conveyor. The conveyor may transport the partially-formed container to a sterilization station and then to a filling station. In the filling station, a food product may be dispensed into the partially-formed container through the open top.

The filled and partially-formed container may then be conveyed to a top-folding and sealing station for folding and sealing the top region.

Figure 7:
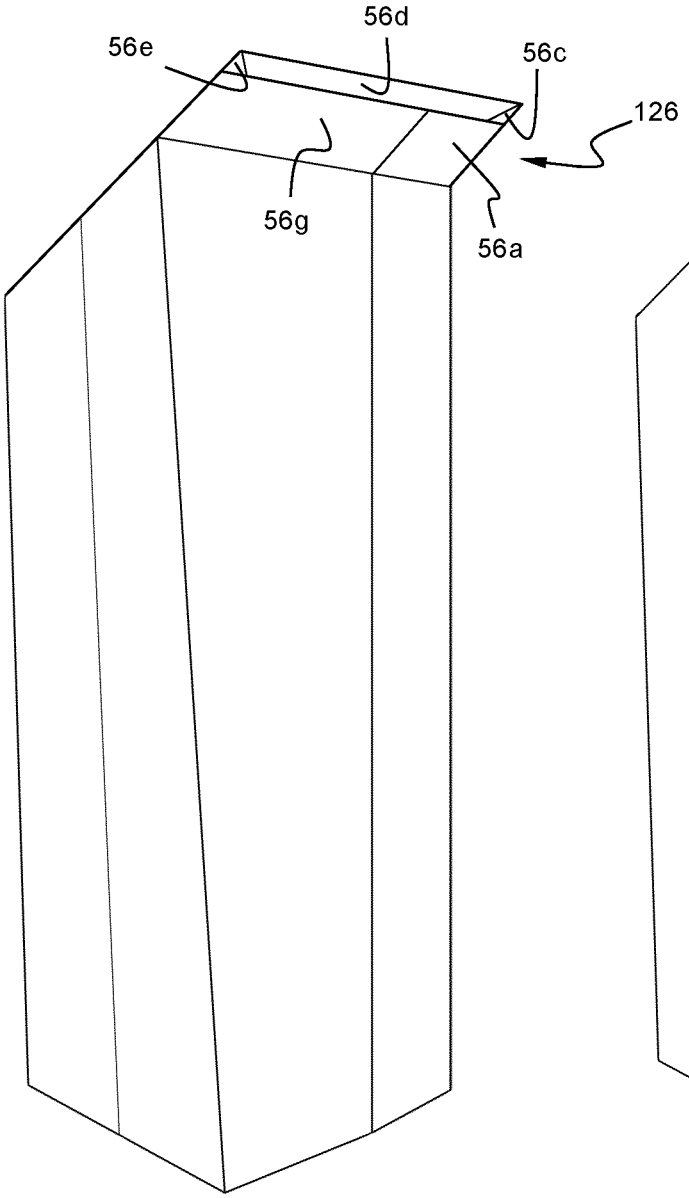
FIGS. 7 and 8 illustrate top-sealing of the sleeve according to FIG. 4.
Figure 8:
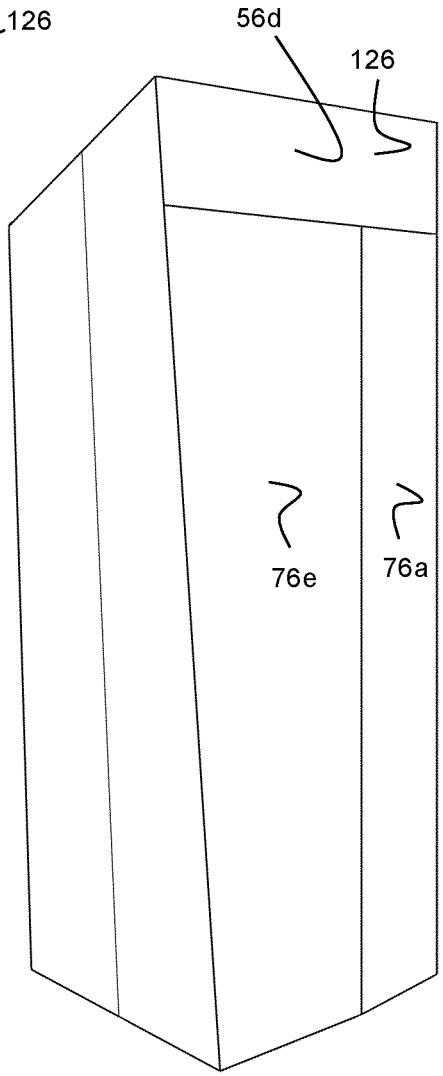

When folding the top region, the slanted top panels 44*c* and 44*d* are pushed inward at crease line 48 to fold panel 44*d* over panel 44*c* and to fold panel 56*e* over 56*f* (see FIG. 6). A similar operation is carried out on panels 44*a*, 44*b* and 56*c*, 56*b* (see also FIG. 1). At the end of this folding operation, the top panel 50 will have assumed a slanted orientation, as shown in FIG. 7. In this position, the gusset panels 44*a*-44*d* are folded onto each other underneath the top panel 50 and the panels of the sealing band 56 may be sealed to each other, e.g. in a welding operation, thereby sealing the top region. The folded and sealed sealing band 56 is then folded down onto and attached to the rear wall panels 76*a* and 76*e*, as is shown in FIG. 8.

Since the top sealing band panels 56*b*, 56*c*, 56*e* and 56*f* are pushed inwards when the top seal is formed, the top sealing band panels 56*b*, 56*c*, 56*e* and 56*f* will be contained between top sealing band panel 56*d* and the joined top sealing band panel 56*g* and 56*a*. Consequently, the folded and sealed sealing band 56 will have a lateral extent corresponding to the lateral extent of the top sealing band panel 56*d*, thus allowing the whole sealing band 56 to be folded down onto and attached to the rear wall panels 76*a* and 76*e*.

Consequently, the folded and sealed sealing band 56 forms a top sealing region that is folded onto and is attached to a rear wall section of the container formed from the rear wall panels 76*a* and 76*e*, i.e. the wall section containing the longitudinal sealing band 14. The consequence of this arrangement, as will be discussed in more detail later, is that a top panel of the container 124 (see FIG. 13), formed from panel 50 (see FIG. 3), will be free from sealing structures, such as welded, glued or otherwise permanently joined seams where panels of the laminate sheet material are permanently joined to each other. This allows the top panel to be utilised in an efficient manner.

A tear-flap may be arranged over and attached to the removable section 72 of the top panel 50 (see FIG. 3) to allow easy removal of the removable section 72.

FIGS. 9-12 show a container 100 produced from the blank 10 disclosed above. The container 100 comprises a substantially planar bottom portion 102, a top portion 104 and a wall portion 106. The wall portion 106 comprises a front wall section 108*a* formed from panel 76*c* and a rear wall section 108*c* formed from panels 76*a* and 76*e*. Further, the wall portion 106 comprises side wall sections 108*b* and 108*d* formed from panels 76*d* and 76*b*, respectively. An edge 116, formed by crease line 82*b*, defines an intersection of the front wall section 108*a* and the side wall section 108*d*, and an edge 118, formed by crease line 82*c*, defines an intersection of the front wall section 108*a* and the side wall section 108*b*. Further, an edge 120, formed by crease line 82*a*, defines an intersection of the rear wall section 108*c* and the side wall section 108*d*, and an edge 122, formed by crease line 82*d*, defines an intersection of the rear wall section 108*c* and the side wall section 108*b*.

The top portion 104 comprises a top panel 124, formed from panel 50, and a sealing region 126, formed from the sealed sealing band 56, i.e. the folded and sealed top sealing band panels 56*a*-56*g*, forming a top seal of the container 100. A slanted side edge 128, formed by crease line 52, defines an intersection of the top panel 124 and the side wall section 108*d*, and a slanted side edge 130, formed by crease line 54, defines an intersection of the top panel 124 and the side wall section 108*b*. A front edge 132, formed by crease line section 30*c*, defines an intersection of the top panel 124 and the front wall section 108*a*. The container 100 also comprises a rear edge 134, formed by crease line section 58*c*, corresponding to the intersection of the top panel 124 and the sealing region 126. Consequently, the top panel 124 extends between the top edges 128, 130, 132 and 134.

As previously discussed, the sealing region 126 is folded down onto and attached to the rear wall section 108*c*, i.e. the wall section formed by the panels 76*a* and 76*e* and containing the longitudinal sealing band 14.

The panel 76*c* has a length $L_F$ along the central axis $C_a$ (see FIG. 1). The panels 76*a* and 76*e* have a length $L_B$ in the direction of the central axis $C_a$ that is less than $L_F$. Consequently, the front wall section 108*a* has a length that is less than the length of the rear wall section 108*c* (when viewed in the longitudinal direction of the carton 100). This difference in the lengths, i.e., $L_F<L_B$, creates an extended configuration of the top panel 124. Thus, the front edge 132 is lower than the rear edge 134 when the container 100 is in an upright position as shown. The top panel 124 is at a predetermined angle α to the rear wall section 108*c* (see FIGS. 11 and 12). The angle α can be about 10 degrees to about 90 degrees, and preferably, about 30 degrees to about 80 degrees. Most preferably, the angle α is about 45 degrees to about 75 degrees. In the present embodiment, the angle is approximately 60 degrees, as is dictated by the angle between the crease line sections 30*b* and 30*d* and crease lines 82*a* and 82*d*, respectively (see FIG. 1).

Figure 5:
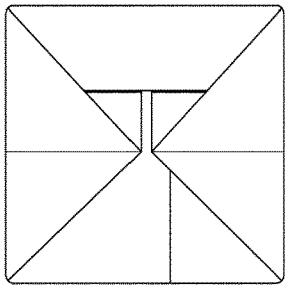
FIG. 5 shows a bottom-view of the sleeve according to FIG. 4 after having been bottom-sealed.
Figure 14B:
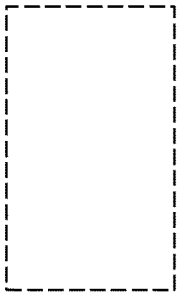
FIGS. 14*a* and 14*b* illustrate cross-sections of the container produced from the blank according to FIG. 1.
Figure 14A:
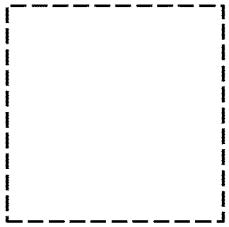

Referring now to FIGS. 14*a* and 14*b*, the planar bottom portion 102 is substantially square-shaped, i.e. it has a width and a breadth of substantially equal length, as is illustrated in FIG. 14*a* (see also FIG. 5). At the top portion 104, however, the cross-section of the container 100, when viewed in a plan parallel to the plane of the bottom portion 102, is rectangular. In other words, above the bottom portion 102 the width of the container 100 is larger than the breadth of the container 100, as is illustrated in FIG. 14*b*. This asymmetry increases when moving from the bottom portion 102 towards the top portion 104.

Figure 9:
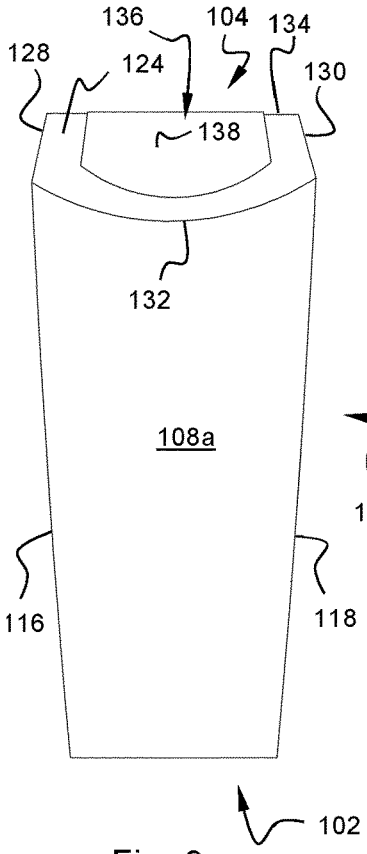
FIG. 9 is a front view of a container produced from the blank according to FIG. 1.
Figure 10:
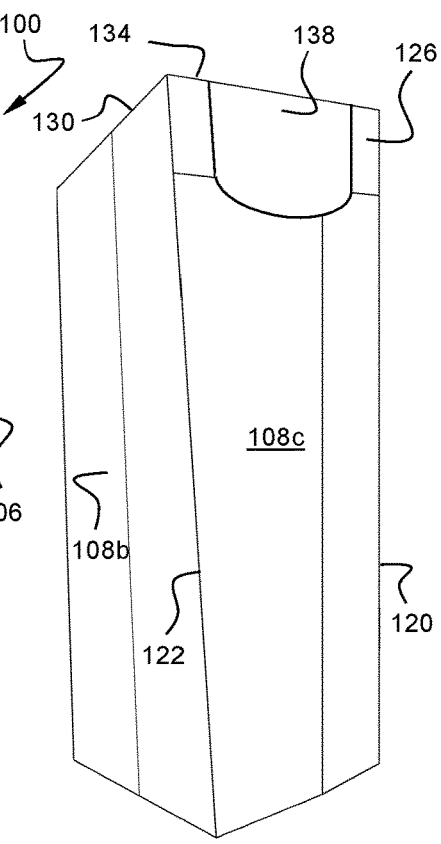
FIG. 10 is a perspective view of the container produced from the blank according to FIG. 1.
Figure 13:
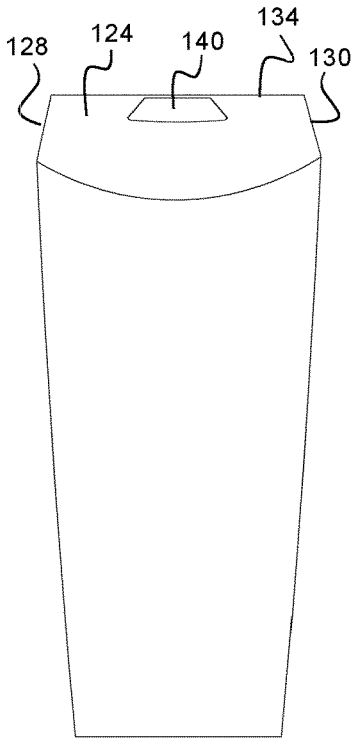
FIG. 13 is a front view of the container produced from the blank according to FIG. 1 in an open position.
Figure 11:
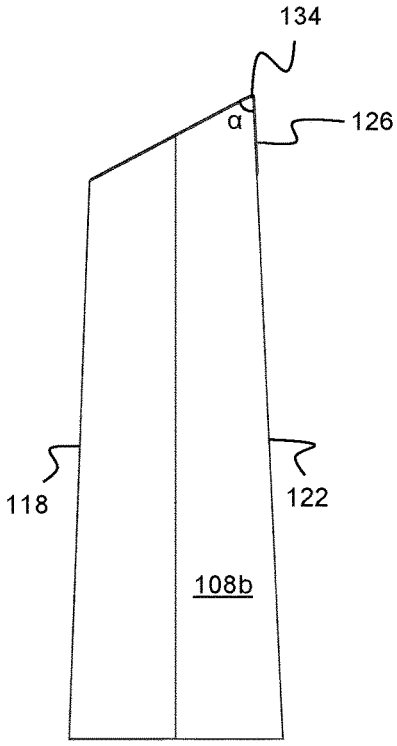
FIGS. 11 and 12 are side views of the container produced from the blank according to FIG. 1.
Figure 12:
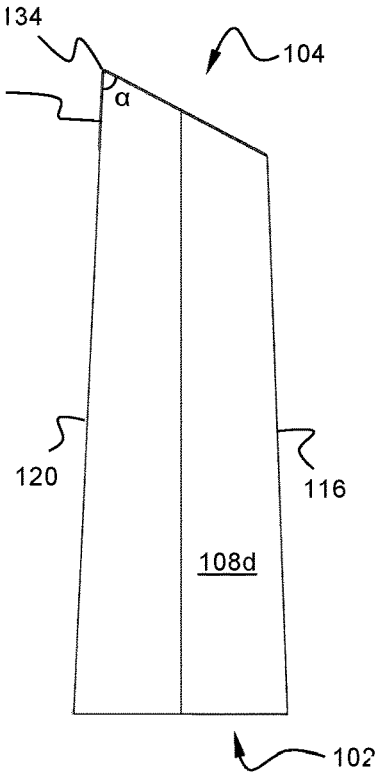

Referring now to FIGS. 9, 10 and 13, the container 100 comprises an opening device or closure 136 having a tear-flap 138 that covers and is attached to the removable section 72 of the top panel 50 (see also FIG. 1). As previously discussed, the removable section 72 is delimited by a line of weakness 74 allowing the section 72 to be removed from the container 100 together with the tear-flap 138 when the container is initially opened. Until this first opening, however, section 72 forms, together with the rest of the top panel 124, an uninterrupted barrier for the food product contained in the package. The line of weakness 74 may, for example, be a so-called "half-cut", i.e. a cut made partially through the laminated substrate of the blank from the outside surface thereof leaving one or a plurality of inner layers of the laminated substrate intact to provide an uninterrupted barrier against the contained food product. When the tear-flap and the attached section 72 is removed from the container 100, an opening 140 (see FIG. 13) will be revealed in the top panel 124 through which the food product in the container 100 can be dispensed or accessed. The tear-flap 138 may extend down onto the rear wall section 108*c* crossing the sealing region 126. The tear-flap 138 may be attached to the container 100 after the container 100 has been filled and top-sealed. Alternatively, the tear-flap 138 may be attached to the proto-container upstream of the filling station.

It is to be understood, however, that the container, in principle, can be fitted with any type of opening device or closure known in the art, e.g. an opening device or closure comprising a pour spout and a cap resealably arranged on the pour spout. Alternatively, the opening device or closure may be implemented using so called pre-laminated hole (PLH) technology to provide the uninterrupted barrier. As is known in the art, such technology involves making a through-hole in the blank, i.e. in the paper-based or paperboard-based laminate sheet material of the container, and covering the hole, preferably from the inside surface of the container, with a suitable barrier layer, e.g. a polymer film, which barrier layer is attached to a tear-flap to be removed from the hole together with the tear-flap at a first opening.

The opening 140 is positioned close to the rear edge 134 substantially equidistant from slanted edges 128 and 130. The opening 140 may be arranged at an orthogonal distance D of between 1 mm to 10 mm from the fourth top edge 134. In other words, with reference to FIG. 1, the removable section 72 may be arranged at an orthogonal distance D of between 1 mm to 10 mm from the crease line section 58*c*. Since the sealing region 126 is folded down onto the rear wall containing the longitudinal sealing band 14 and is attached thereto, the top panel 124 will be free from sealing structures and there will be no obstructions extending above the surface of the top panel 124. In particular, the longitudinal sealing band 14 and the top sealing region 126 will be confined to the rear wall section 108*c* of the container. Therefore, when tear-flap 138 and section 72 are removed, the then revealed opening 140 will become easily accessible, in particular from the rear wall section 108*c* side of the container 100, allowing a consumer to position his or her lower lips on the sealing region 126 and the upper lips over the opening 140. The longitudinal extent of the sealing band panel 56*d*, i.e. the distance A between the crease line section 58*c* and the top boarder section 22*e* (see FIG. 1), defining the length of the sealing region 126 in the longitudinal direction of the container 100, may be at least 15 mm, or more preferably at least 20 mm, or even more preferably at least 30 mm, to comfortably accommodate the lower lips of a consumer and thereby cater for an enjoyable drinking experience. By having the tear-flap 138 extending down onto the rear wall section 108*c* crossing the sealing region 126, the outer surface of the sealing region 126 intended to come into contact with the mouth of a consumer will be protected until the container 100 is opened. The slanted top panel 124 and the position of the opening 140 close to the rear edge 134 allow for an ergonomically advantageous drinking position, thus making it easy for a consumer to drink directly from the container 100. Consequently, the disclosed container 100 may be suitable to be used as a so-called portion pack, i.e. a type of container configured to hold a liquid intended to be consumed on the go, without the container necessarily having to be reclosed after once having been opened.

Because to the gusset panels 44*a*, 44*b*, 44*c*, 44*d* are folded inwards during the top sealing of the container (see FIG. 6), the gusset panels 44*a*, 44*b*, 44*c*, 44*d* will end up underneath the top panel 50 (e.g. see FIG. 3) in the filled and sealed container. Consequently, when designing the opening, due account of the gusset panels 44*a*, 44*b*, 44*c*, 44*d* must be taken. In the present embodiment, the opening 140 is positioned such that the gusset panels 44*a*, 44*b*, 44*c*, 44*d* do not interfere with drinking or dispensing from the container.

Figure 15:
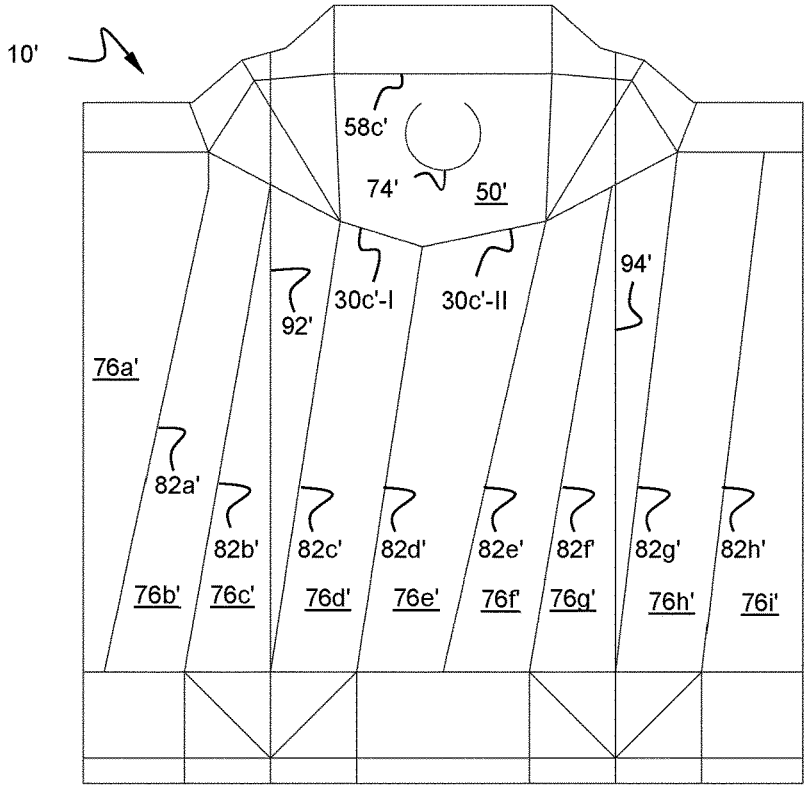
FIG. 15 is an alternative embodiment of a blank.
Figure 16:
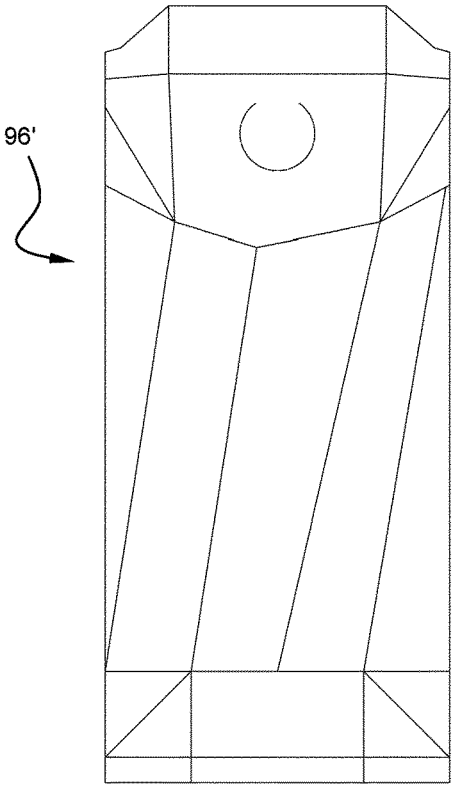
FIGS. 16 and 17 show the blank according to FIG. 15 folded and sealed to form a sleeve.
Figure 17:
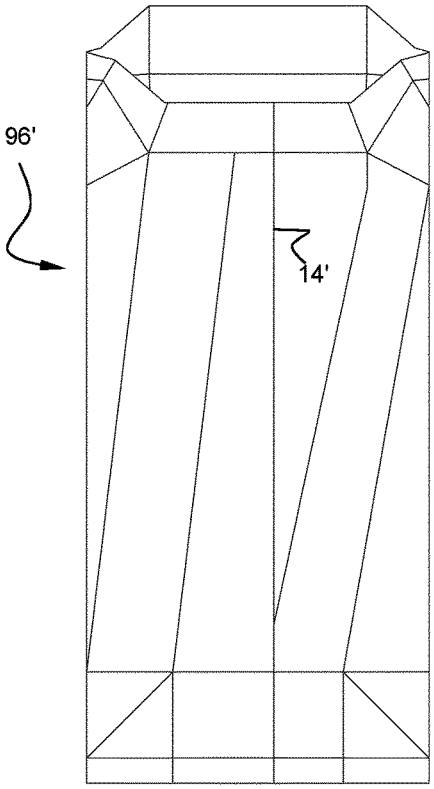
Figures 18, 19, 20, 21:
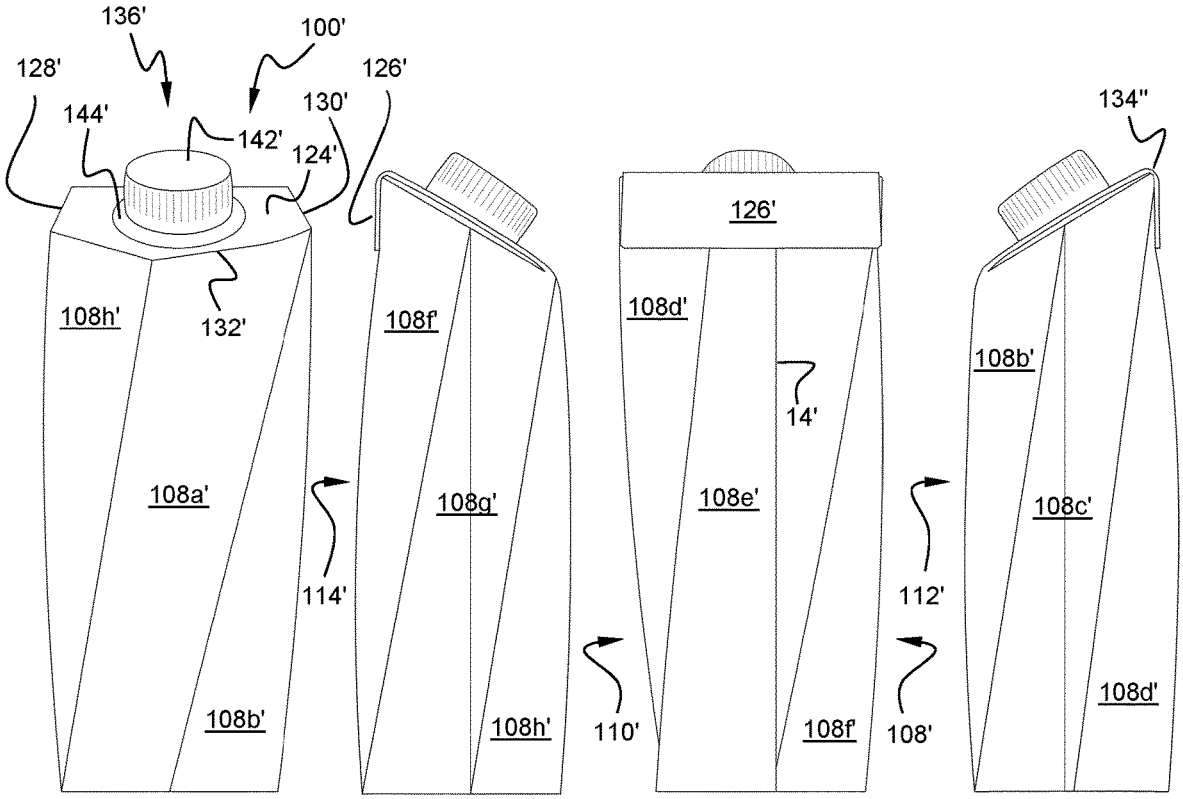
FIGS. 18-21 are front, side and rear views of a container produced from the blank according to FIG. 15.

FIG. 15 shows another embodiment of a blank 10' according to the invention. FIGS. 16 and 17 show a sleeve 96' produced from the blank 10' and FIGS. 18-21 illustrates a container 100' produced from the sleeves 96'.

The blank 10' differs from the previously disclosed blank 10 in that the blank 10' comprises two rectilinear or substantially rectilinear crease line sections 30*c*'-I and 30*c*'-II instead of the curvilinear crease line 30*c* of blank 10.

Furthermore, the blank 10' comprises a semi-circular line of weakness 74' instead of the loop of weakness 74 of blank 10, which semi-circular line of weakness 74' defines a panel section 72' arranged to be folded out from the plane of panel 50' during the first opening. Also, the line of weakness 74' is positioned further from the crease line section 58*c*' than the loop of weakness 74 from crease line section 58*c*. Similar to the loop of weakness 74 of blank 10, the semi-circular line of weakness 74' may be a so-called "half-cut", i.e. a cut made partially through the laminated substrate of the blank from the outside surface thereof leaving one or a plurality of inner layers of the laminated substrate intact to provide an uninterrupted barrier against the contained food product.

The blank 10' differs from blank 10 also in that the intermediate region of the blank 10' comprises slanted crease lines 82*a*'-82*g*' instead of the substantially longitudinally extending crease lines 82*a*-82*d* of blank 10. The slanted crease lines 82*a*'-82*h*' partition slanted panels 76*a*'-76*i*'.

The blank 10' is otherwise identical to blank 10 and the sleeve 96' (see FIGS. 16 and 17) is produced in substantially the same manner as sleeve 96. The container 100' is produced from sleeve 96' in substantially the same manner as container 100 from sleeve 96. However, when the sleeve 96' is erected and folded, the slanted panels 76*a*'-76*i*' will form a pattern of slanted and slightly warped wall sections 108*a*'-108*h*' in the wall portion 106' of the container 100'. Wall sections 108*a*', 108*g*', 108*e*' and 108*c*' extend diagonally across the front wall, the first side wall, the rear wall and the second side wall, respectively, of the container 100'. When the carton 100' is produced, the sealing region 126' is folded down onto wall section 108*d*' and wall section 108*e*' (i.e. the wall section containing the longitudinal sealing band 14') and is attached to the same. Consequently, as the previously discussed container 100, the container 100' comprises a top panel 124' that is free from sealing structures.

Also, instead of being provided with a tear-flap, the carton 100' is provided with an opening device or closure 136' comprising a cap 142' and a pour spout having a flange 144' attached to the top panel 124' above the line of weakness 74'. The opening device or closure 136' is configured to break the line of weakness 74' during a first opening of the container 100' in a manner that is, as such, known in the art. For example, the opening device or closure 136' may comprise a seal-breaking member (not shown) arranged inside the pour spout which is activated during the first opening to push down onto panel section 72' and force the panel section 72' into the container so that an opening in the top panel substrate is created. However, the section 72' will not separate from the rest of the top panel substrate but will remain attached to the same via the uncut substrate region located between the endpoints of the line of weakness 74'.

Figure 22:
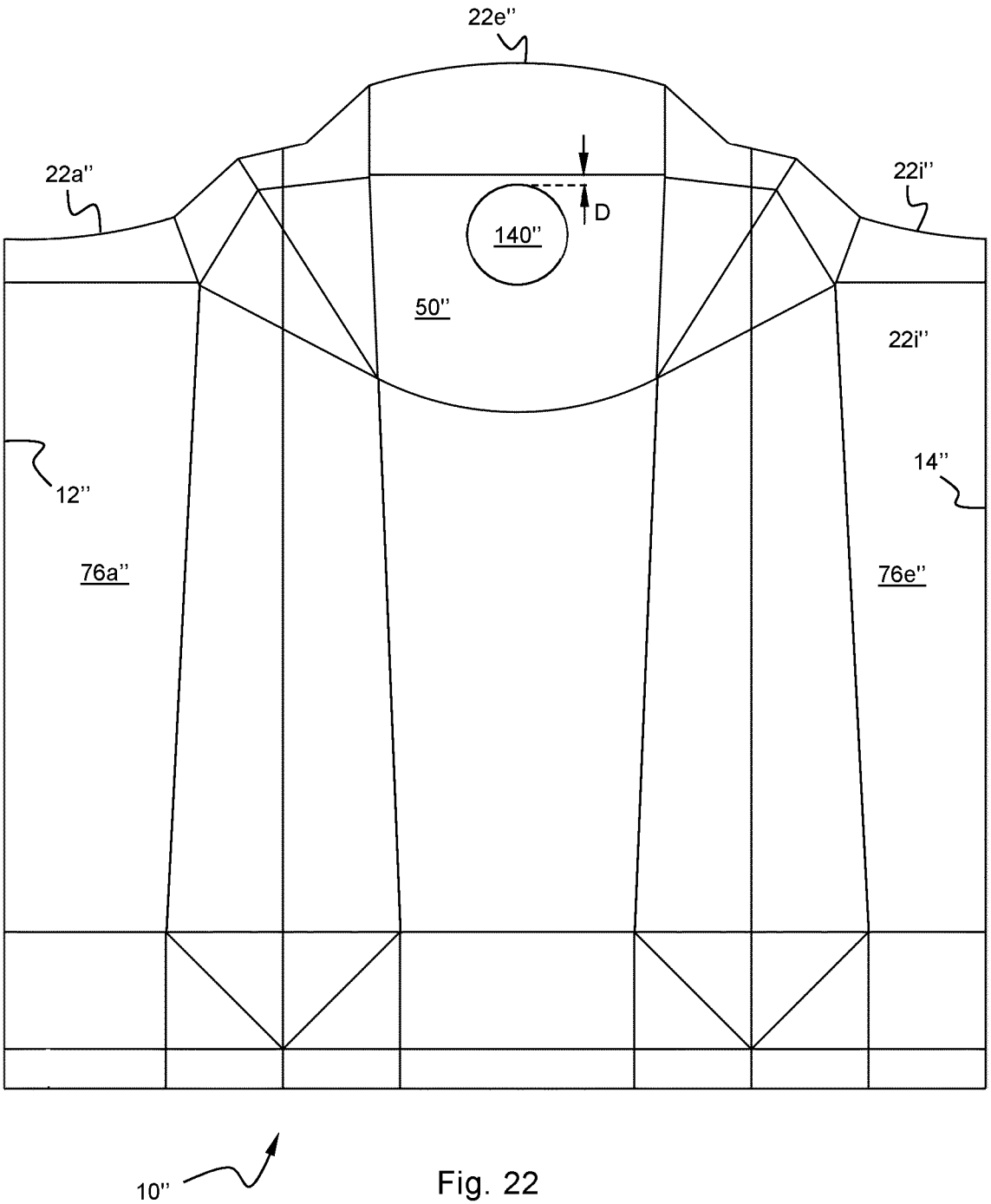
FIG. 22 shows an embodiment of a blank.
Figure 23:
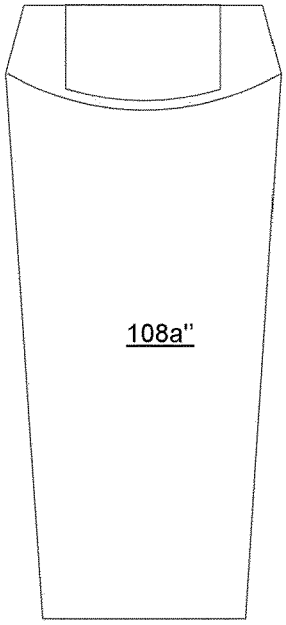
FIGS. 23-25 show a container formed from the blank according to FIG. 22.

FIG. 22 shows a blank 10" which is substantially identical to the blank 10 shown in FIG. 1 except that the top boundary edge sections 22*a*", 22*e*" and 22*i*" are curvilinear and the top panel 50" is provided with a circular, pre-cut opening 140" in the paper-based or paperboard-based laminate sheet material of the blank 10". The opening 140" is positioned adjacent the crease line section 58*c*" and may, similarly to the removable section 72 in FIG. 1, be arranged at an orthogonal distance D of between 1 mm to 10 mm from the crease line section 58*c*". Also, as compared to the blank 10 shown in FIG. 1, the panel 76*a*" is somewhat wider than the panel 76*e*" allowing the boundary edge 14" to become positioned substantially equidistant from the edges 120" and 122" in a container 100" produced from the blank 10" (see FIGS. 23-27).

In the region of the opening 140", the inside surface of the blank 10' is provided with a sheet membrane (not shown) covering the opening 140", thus providing a pre-laminated hole (PLH) configuration forming a barrier separating the opening 140" from the food product prior to a first opening of the container. It is understood, however, that the barrier, instead of being formed by a pre-laminated hole (PLH) configuration, may comprise, as in the embodiment disclosed in FIGS. 1-13, a removable section delimited by a half-cut, i.e. a cut made partially through the top panel from an outside surface thereof leaving one or a plurality of inner layers of the laminated substrate or sheet material intact to provide said barrier.

FIGS. 23-27 show the container 100" produced from the blank 10". The container 100" is produced substantially in the same way as has been described above with reference to FIGS. 2-8. Due to the curvilinear nature of the top boundary edge sections 22*a*", 22*e*" and 22*i*", the sealing region 126" displays a curvilinear edge 127" in this embodiment of the container.

The container 100" comprises an opening device or closure 136" arranged over the opening 140" allowing a consumer to break the PLH barrier, open the container and dispense or access the food product.

The opening device or closure 136" comprises a first sheet 150 and a second sheet 160. The first sheet 150 is attached to the outside surface of the paper-based or paperboard-based laminate sheet material of the container 100". The second sheet 160 is releasably attached to the outside surface of the first sheet 150, allowing the second sheet 160 to be brought from a first position, in which the opening device or closure 136" is closed (see FIGS. 23-25) to a second position, in which the opening device or closure 136" is open (see FIGS. 26 and 27).

Figure 28:
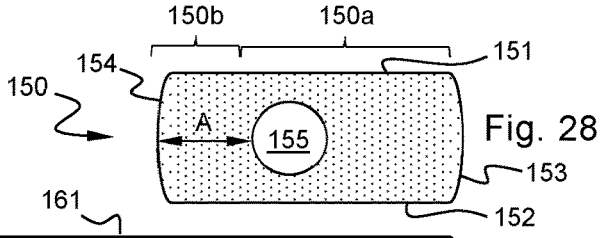
FIGS. 28 and 29 illustrate an opening device or closure of the container according to FIGS. 23-27.

The first sheet 150 is generally rectangular and extends between longitudinal edges 151, 152 and transversal edges 153, 154 (see FIG. 28, which shows the first sheet 150 prior to having been mounted to the laminate sheet material). The first sheet 150 displays a through-opening 155 having substantially the same size and shape as the opening 140" (see FIG. 22). In other words, the opening 140" and the through-opening 152 are congruent. The first sheet 150 is attached to the outside surface of the laminate sheet material of the container 100" so that the through opening 155 is aligned with the opening 140". Consequently, in the present embodiment, in which the opening 140" and the through-opening 155 are circular, the opening 140" and the through-opening 155 are coaxially arranged.

Figure 26:
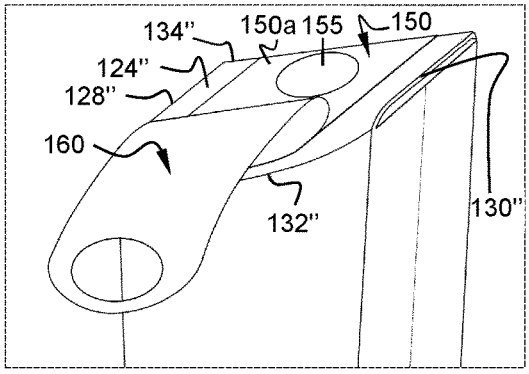
FIGS. 26 and 27 show the container according to FIGS. 23-25 in an open position.
Figure 27:
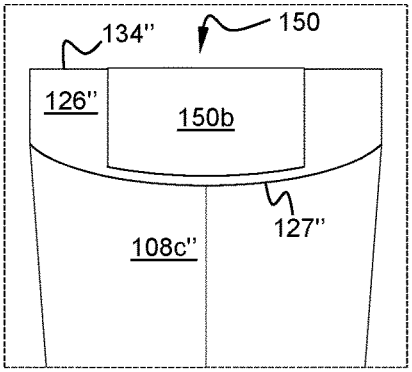

The first sheet 150 comprises a first sheet section 150*a* that extends over the top panel 124" between the top edge 134" of the container 100" and a region close to the edge 132" (see FIG. 26). In the disclosed embodiment, the first sheet 150 also comprises a second sheet section 150*b* that extends from the top edge 134" down onto the sealing region 126" to a region close to the edge 127" (see FIG. 27). Consequently, due to the transversal edge 153 of first sheet 150 being arranged adjacent the edge 132" and the transversal edge 154 being arranged adjacent the edge 127", the first sheet 150 extends over the uppermost edge 134" of the container 100" and over substantially the whole length of the top panel 124" and the sealing region 126", respectively.

In the present embodiment, the width of the first sheet 150 is somewhat smaller than the width of the top panel 124". In other words, the sheet 150 does not extend all the way to the edges 128" and 130" (see FIG. 26). In alternative embodiments, the first sheet 150 may have a width that is substantially equal to the width of the top panel 124". The extent of the first sheet 150 should, however, be sufficient to encircle the opening 140".

Figure 29:
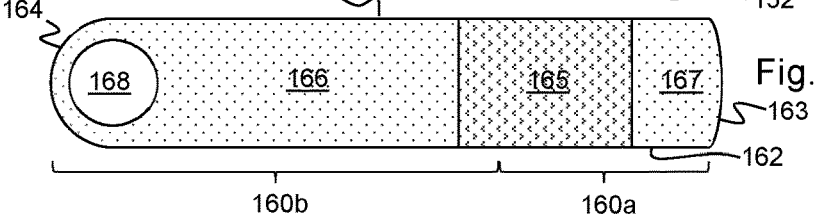

The second sheet 160 is also generally rectangular and extends between longitudinal edges 161, 162 and transversal edges 163, 164 (see FIG. 29, which shows the second sheet 160 prior to having been mounted to from the opening device or closure 136"). The second sheet 160 has substantially the same width as the first sheet 150. The length of the second sheet 160, however, is substantially twice the length of the first sheet 150.

Figure 24:
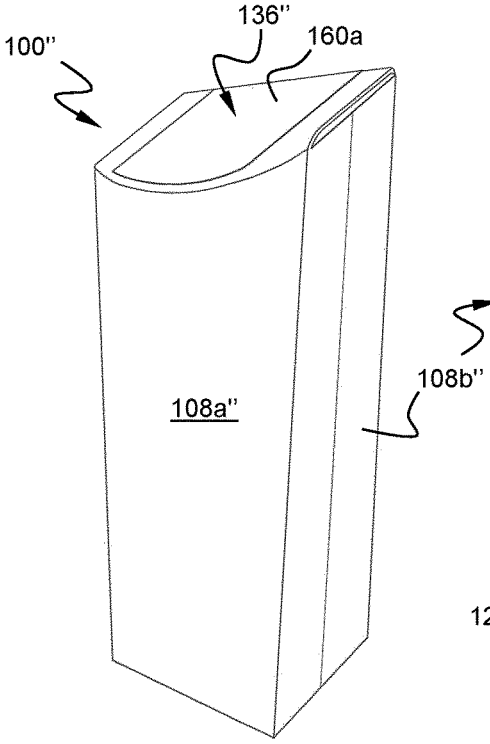
Figure 25:
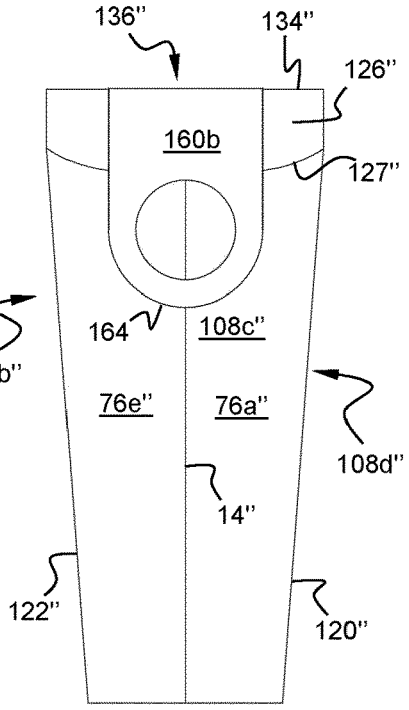

The second sheet 160 comprises a first sheet section 160*a* which, prior to a first opening of the container 100", extends over the first sheet 150 between the top edge 134" of the container 100" and a region close to the edge 132" (see FIGS. 24 and 29). The transversal edge 163 of the second sheet 160 is substantially aligned with the transversal edge 153 of the first sheet 150. The second sheet 160 also comprises a second sheet section 160*b* which, prior to the first opening of the container 100", extends from the top edge 134" down onto the second sheet section 150*b* of the first sheet 150, over the edge 127" of the sealing region 126" and down onto the wall section 108*c*" of the container 100" (see FIG. 25).

The outside surface of the first sheet 150 may comprise an adhesive (indicated by a dotted pattern in FIG. 28). The inside surface of the second sheet 160, i.e. the surface which is configured to contact the first sheet 150 and the laminate sheet material of the container 100" at the side wall section 108*c*" prior to the first opening, may also comprise an adhesive. However, in one embodiment the inside surface of the sheet 160 may comprise a region 165, arranged to cover the through-opening 155 of the first sheet 150, in which the adhesiveness is reduced as compared to surrounding sections 166 and 167 (see FIG. 29).

Prior to the first opening of the container 100", the second sheet 160 is attached to the outside surface of the first sheet 150. Also, to ensure that the second sheet 160 is kept flush to the container 100" prior to the first opening, the second sheet 160 may be attached to the side wall section 108*c*". As stated above, the inside surface of the blank 10' is provided with a sheet membrane (not shown) covering the opening 140" and forming a barrier prior to the first opening. The outside surface of the sheet membrane, which is exposed via the opening 140" and the through-opening 155, is attached to the inside surface of the second sheet 160. However, if the barrier comprises a removable section delimited by a half-cut instead of being formed by a PLH configuration, the inside surface of the second sheet material 160 would instead be attached to the outside surface of the removable section, which is exposed via the through-opening 155 in a similar manner as the PLH membrane.

In order to perform the first opening, a consumer manually grips the transversal edge 164 of the second sheet 160 and pulls the second sheet 160 upward over the top edge 134" and then downwards towards the edge 132", thereby bringing the second sheet 160 to the position shown in FIG. 26. The downward pulling action will reveal the through-opening 155 and break the sheet membrane covering the opening 140". If the barrier comprises a removable section delimited by a half-cut, as is discussed above, the downward pulling action will break the half-cut, lift the removable section and reveal an opening similar to the opening 140". When the second sheet 160 has been brought to the position showed in FIG. 26, the consumer will be able to dispense or access the food product through the opening 140" and the through-opening 155.

Due to the first sheet 150 extending from the through-opening 155, over the top edge 134" and down onto the sealing region 126" to the region close to the edge 127" (see FIG. 27), a drinking surface, which prior to the first opening was covered by the second sheet 160, will be available to the consumer should he or she chose to drink from the container 100" from the side of the wall section 108*c*". In order to prevent the mouth of the consumer from coming into contact with the outside surface of the container laminate sheet material during such a drinking operation, and thereby provide an enjoyable drinking experience, the first sheet 150 should preferably extend from the through-opening 155 to a distance A from the through-opening 155 of at least at 20 mm and more preferably at least 25 mm, and even more preferably at least 30 mm (see FIG. 28).

According to one embodiment, the second sheet 160 may be configured to allow the consumer to reclose the opening device or closure 136" after the first opening. This may be effectuated by the consumer bringing the second sheet 160 back to its original, first position, and allowing the second sheet 160 to adhere to the first sheet region 150*a* of the first sheet 150 in the sealing region 126". While this may not necessarily be sufficient to provide a liquid tight seal, it may be sufficient to prevent foreign object from entering the through-opening 155.

At the region of the edges 153 and 163, the first and second sheets 150, 160 may be permanently joined, e.g. heat sealed to each other, thereby ensuring that the second sheet 160 remains attached to the first sheet 150 also after the first opening.

The first sheet 150 may be heat-sealed to the outside surface of the container 100". Alternatively, the first sheet 150 may be permanently attached to the outside surface of the container 100" by other means, e.g. using a suitable adhesive.

The first and second sheets 150, 160 may comprise a polymer sheet, e.g. a sheet comprising a polyethylene layer or a polypropylene layer or both. At least the second sheet 160 may be a laminate sheet, e.g. comprising a plurality of polymer layers and/or a layer comprising cellulose fibres, e.g. a paper layer. In one embodiment, the second sheet 160 may comprise an aluminium layer.

During production of the container 100", the first and second sheets 150 and 160 may be attached to each other to form a sheet aggregate. The sheet aggregate may subsequently be attached to the outside surface of the container laminate sheet material. Alternatively, the first sheet 150 may attached to the outside surface of the container laminate sheet material in a first step and the second sheet 160 may be attached to the first sheet 150 in a second, subsequent step. The sheet aggregate, or the first sheet 150 and subsequently the second sheet 160, may be attached to the container laminate sheet material after the container has been folded, filled and top-sealed. In an alternative embodiment of producing the container 100", the first sheet 150 may be attached to the blank 10" prior to the blank 10" is folded to form the sleeve.

As previously stated, blanks are produced in a converting process in which the blanks are cut from a web of laminate material having substantially parallel and rectilinear lateral boundary edges. The converting process typically comprises feeding the web of laminate material through one or a plurality of nips formed between a pair of cutting and/or creasing rollers to produce blanks cut from the web and formed with creases lines for subsequent folding and/or with cuts and/or with holes, e.g. for fitting a closure to the blank material when a carton is produced therefrom.

Figure 30:
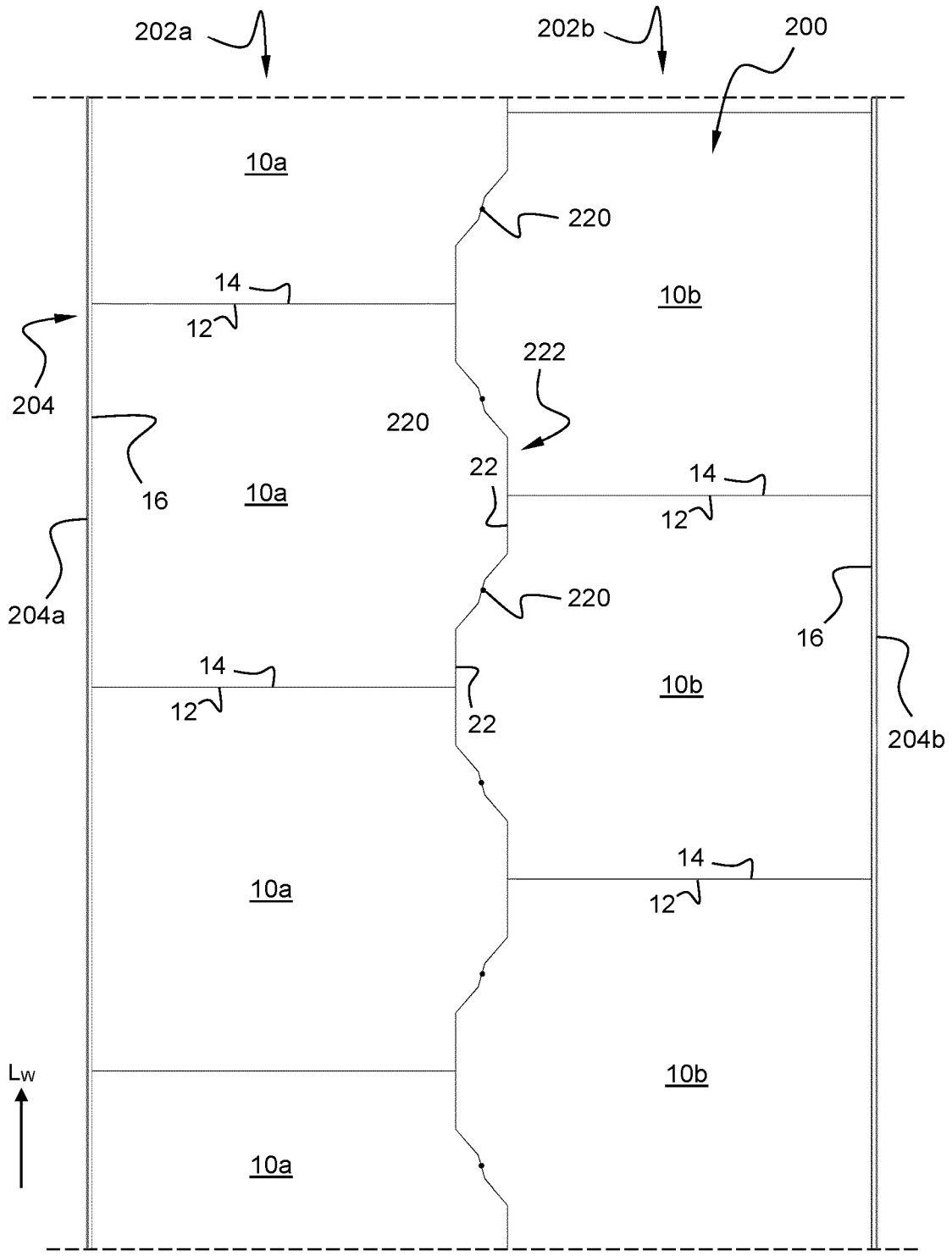
FIG. 30 shows an embodiment of a nesting pattern of the blank according to FIG. 1.
Figure 31:
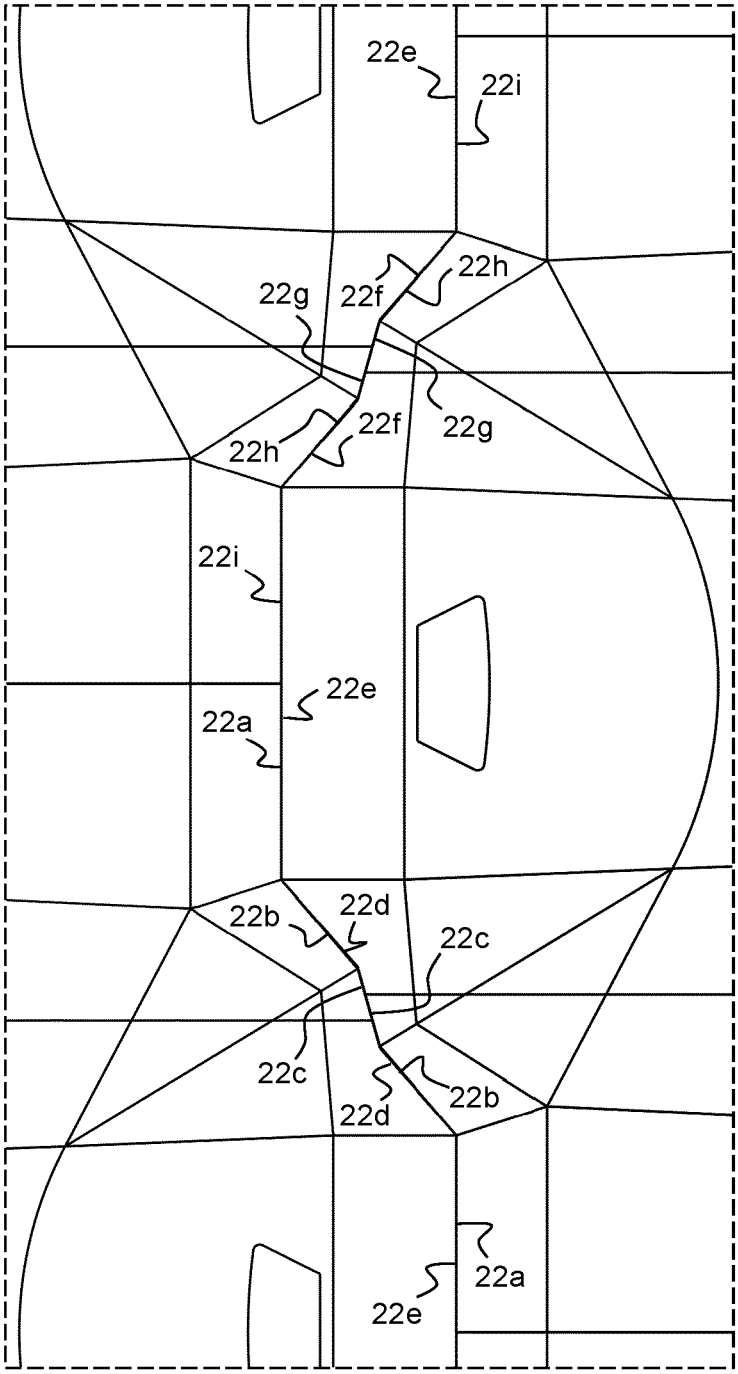
FIG. 31 is a detailed view of the nesting pattern according to FIG. 30.

FIG. 30 shows an embodiment of a nesting pattern of blanks laid out on a web 204 of laminate material. Such a pattern is sometimes referred to as a nesting pattern. The blanks are identical to the one previously discussed with reference to FIG. 1 and FIG. 31 is a detailed view of the nesting pattern of FIG. 30 showing some of the crease lines and the loop of weakness previously discussed with reference to FIG. 1.

As is known in the art, a nesting pattern is not a physical pattern that is visible on the web but a pattern that illustrates how the blanks are intended to be cut from the web and/or how the blanks are impressed. In other words, the nesting pattern illustrates the layout of the blanks on the web and, consequently, how the available web material is utilised.

The nesting pattern 200 shown in FIG. 30 comprises two rows 202*a*, 202*b* of congruent blanks 10*a*, 10*b*, each row comprising blanks arranged side by side with the first lateral boundary edge 12 adjoining the second lateral boundary edge 14 of a neighbouring blank and vice-versa. Consequently, in the nip of the cutting rollers (not shown) adjoining lateral boundary edges 12 and 14 in each row can be produced simultaneously using the same cutting tool utilising a single cutting edge.

The blanks 10*a* of the first row 202*a* are arranged facing the blanks 10*b* of the second row 202*b* so that the top boundary edge 22 of the blanks of the first row 202*a* adjoins the top boundary edge 22 of the blanks of the second row 202*b*. In the longitudinal direction Lw of the web of laminate material 204, the rows 202*a*, 202*b* are offset so that the top boundary edge section 22*e* of the blanks of the first row 202*a* adjoins the top boundary edge sections 22*a* and 22*i* of the blanks of the second row 202*b* and vice-versa (see FIG. 31). Consequently, in the nip of the cutting rollers (not shown) the adjoining top boundary edges 22 of oppositely arranged blanks can also be produced simultaneously using the same cutting tool utilising a single cutting edge.

In each row 202*a*, 202*b*, the bottom boundary edges 16 are arranged substantially parallel to the lateral boundary edges 204*a*, 204*b* of the web 204, either substantially colinear the lateral boundary edges of the web 204 or within a small distance from the lateral boundary edges of the web 204, e.g. within 1 mm to 5 mm from the lateral boundary edges 204*a*, 204*b*. This will provide a nesting pattern allowing substantially the whole area of web 204 to be covered with no or very little web material being wasted. Consequently, the disclosed nesting pattern is very effective in that substantially all available web material is utilised to form blanks.

In the nesting pattern 200, the fourth boundary edges 22 form a non-rectilinear line 222 extending substantially centrally in the longitudinal direction Lw of the web 204. The line 22 display a two-fold rotational symmetry with respect to a plurality of centres 220 located on the line 222. In other words, the line 222, when rotated 180 degrees about any one of the centres 220, will assume the same orientation as before the rotation. This symmetry allows the rows 202*a* and 202*b* to be arranged adjacent each other without any intermediate gaps, thus providing the efficient nesting.

Figure 32:
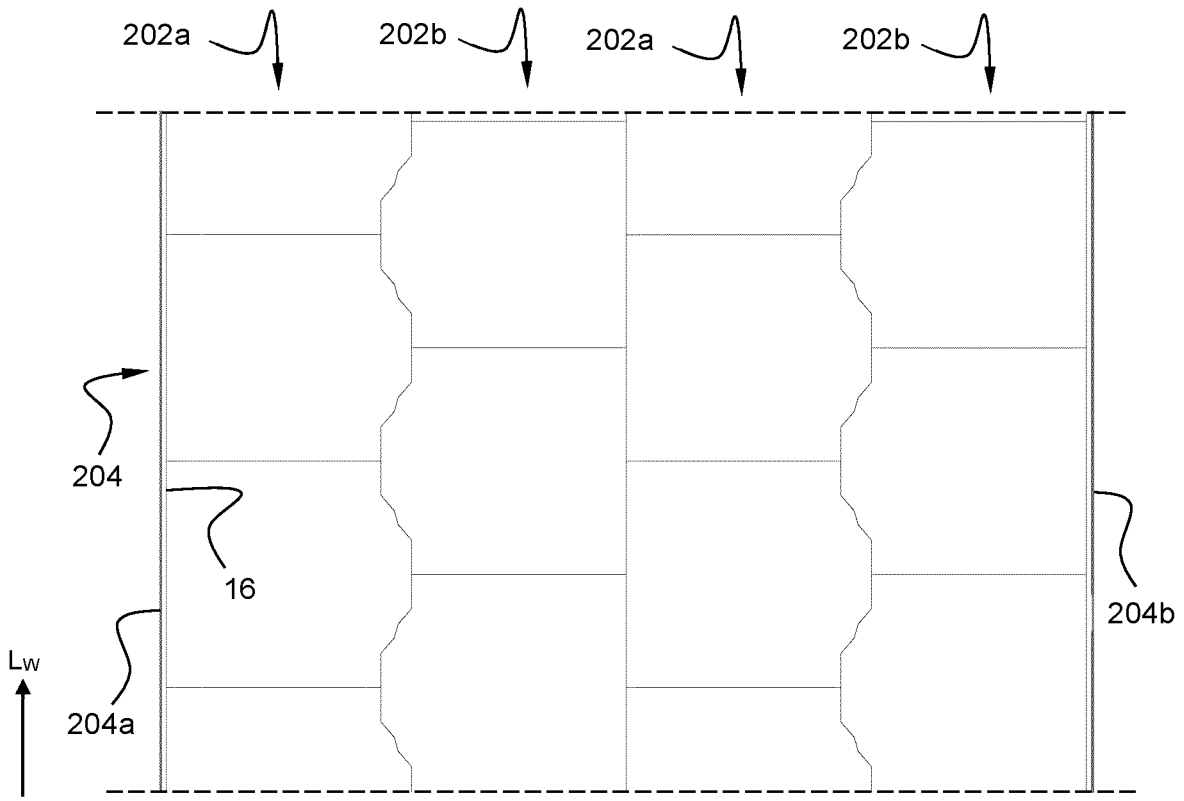
FIG. 32 shows a second embodiment of a nesting pattern of the blank according to FIG. 1.

An efficient nesting can also be achieved by arranging a plurality of such row-pairs adjacent to each other, e.g. as is disclosed in FIG. 32, which shows two row-pairs in such a configuration.

Figure 33:
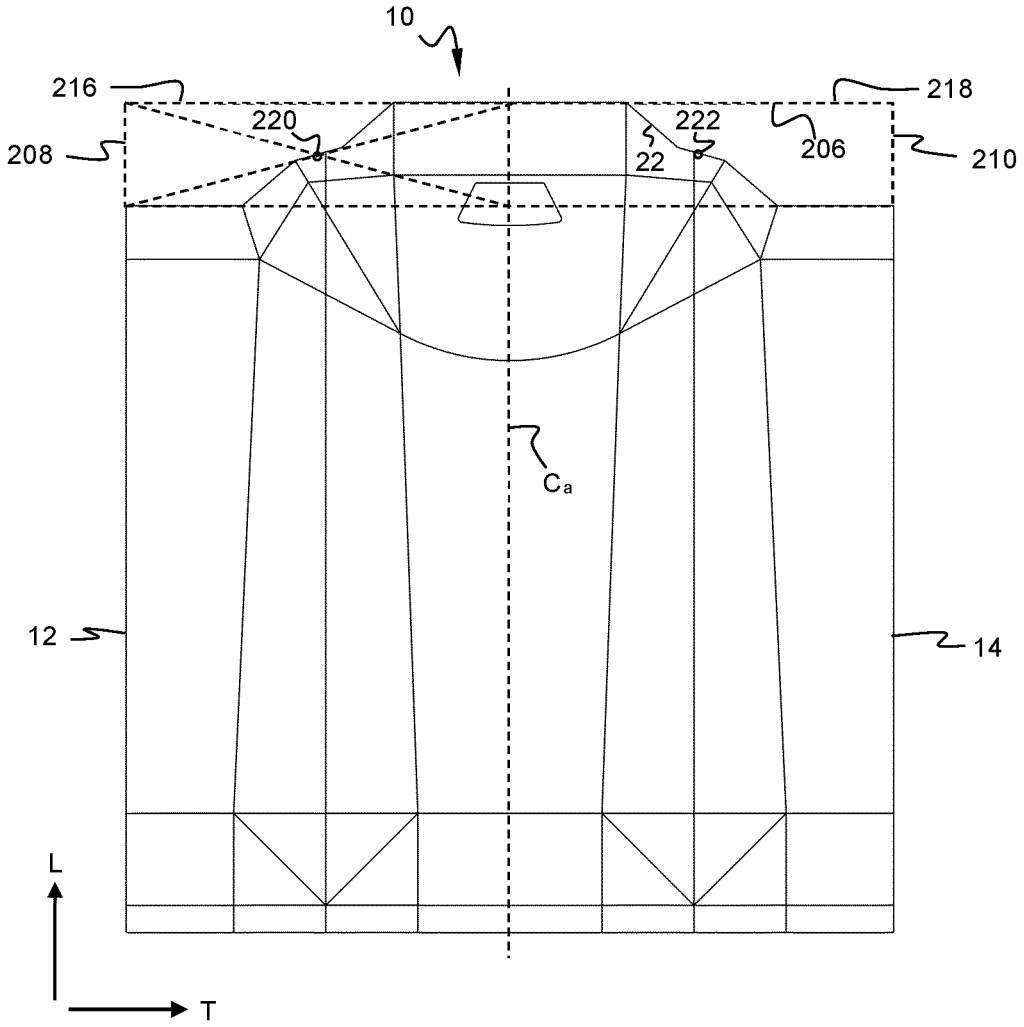
FIG. 33 shows a blank produced from the nesting pattern of any one of FIGS. 30 and 31.

FIG. 33 illustrates the geometry of the blank allowing the above-discussed efficient nesting pattern. The blank 10 is the same blank as previously shown in FIG. 1. The top boundary edge 22 is reflection symmetric with respect to the central axis $C_a$. In other words, using the central axis $C_a$ as an axis of symmetry, the top boundary edge 22 on one side of the axis $C_a$ is mirrored by the top boundary edge 22 on the other side of the axis $C_a$.

The top boundary edge 22 is inscribed in a right rectangle 206. In other words, the top boundary edge 22 is enclosed by and "fits snugly" inside the rectangle 206. The rectangle 206 has a first pair of sides 208, 210 being parallel to the longitudinal direction L of the blank and a second pair of sides 212, 214 being parallel to the transversal direction T. The central axis $C_a$ divides the rectangle 206 into two congruent right sub-rectangles 216 and 218. In other words, the sub-rectangles 216 and 218 are identical in size and shape.

The sub-rectangle 216 has a centre 220, i.e. a position where diagonals of the sub-rectangle 216 intersect. Within the sub-rectangle 216, the top boundary edge 22 displays a two-fold rotational symmetry with respect to an axis running through the centre 220 and being orthogonal to the plane of the blank 10. In other words, the part of the top boundary edge 22 inscribed in the sub-rectangle 216 assumes the same orientation after a rotation of 180 degrees (360/2 degrees) about the centre 220.

The above is equally true for the part of the top boundary edge 22 that is inscribed in the sub-rectangle 218—within the sub-rectangle 218 the top boundary edge 22 displays a two-fold rotational symmetry with respect to an orthogonal axis running through the centre 222 of the sub-rectangle 218. This follows directly from the fact that the top boundary edge 22 is reflection-symmetric with respect to the central axis $C_a$—such reflection symmetry implies equal rotational symmetry about the respective centre in the sub-rectangles 216 and 218. In other words, if the top boundary edge 22 is reflection-symmetric with respect to the central axis $C_a$, and if the part of the top boundary edge 22 inscribed in one of the sub-rectangles displays a two-fold rotational symmetry with respect to the centre of that sub-rectangle, the part of the top boundary edge 22 inscribed in the other sub-rectangle will also display a two-fold rotational symmetry with respect to the centre of that other sub-rectangle.

Arranging the top boundary edge 22 of the blank 10 reflection symmetric with respect to the central axis $C_a$ and, for the part of the top boundary edge 22 being inscribed in respective sub-rectangle, two-fold rotational symmetric with respect to the centre of the sub-rectangle, as described above, will allow the effective nesting pattern disclosed in FIG. 30. In particular, it will allow laying out the pattern of the blanks on the web 204 such that the top boundary edge 22 of the row of blanks 202*a* coincides with the top boundary edge 22 of the row of blanks 202*b*, thus resulting in that there will be no non-used web material between the rows 202*a* and 202*b*.

Figure 34:
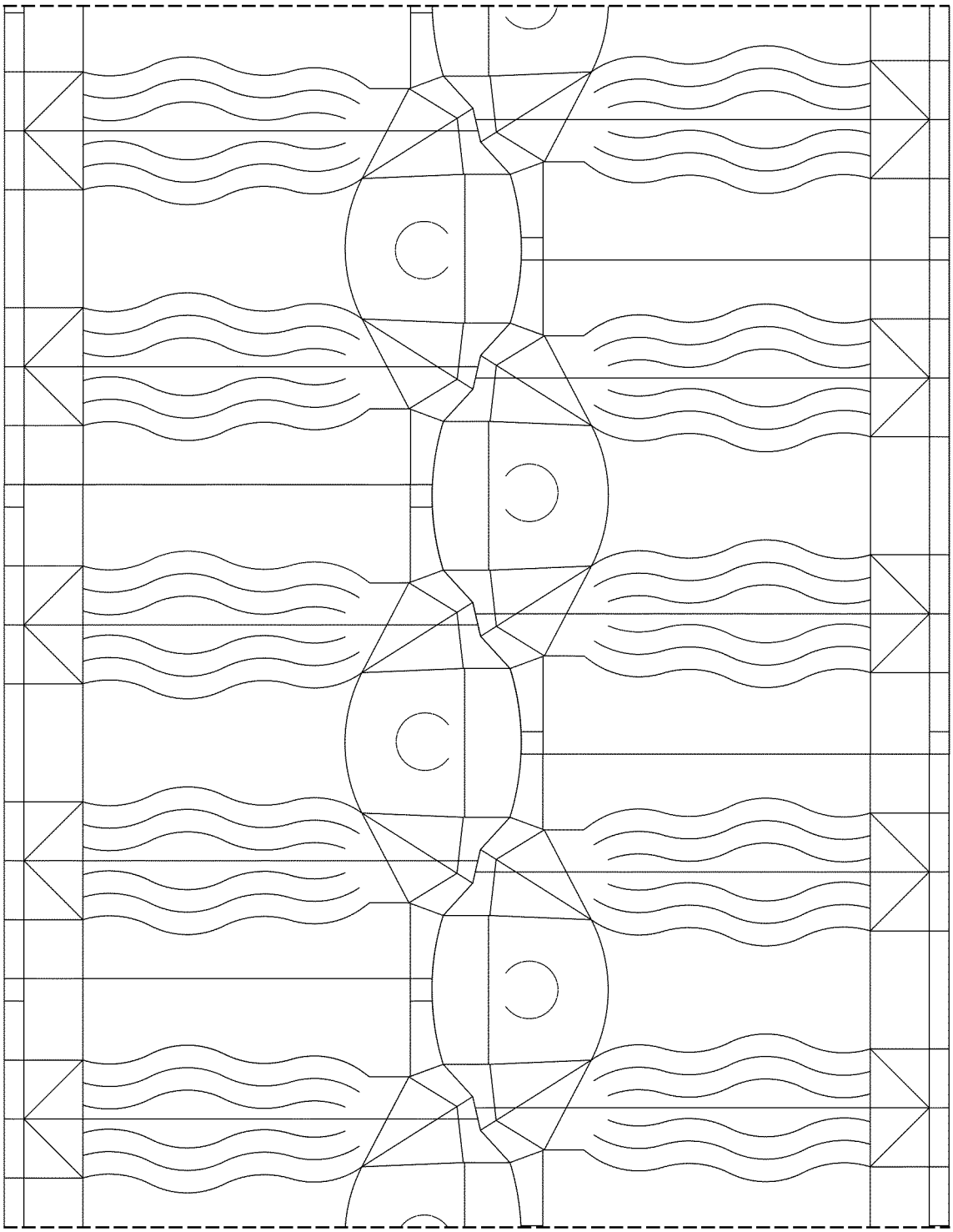
FIG. 34 shows an embodiment of a nesting pattern of a blank.
Figure 35:
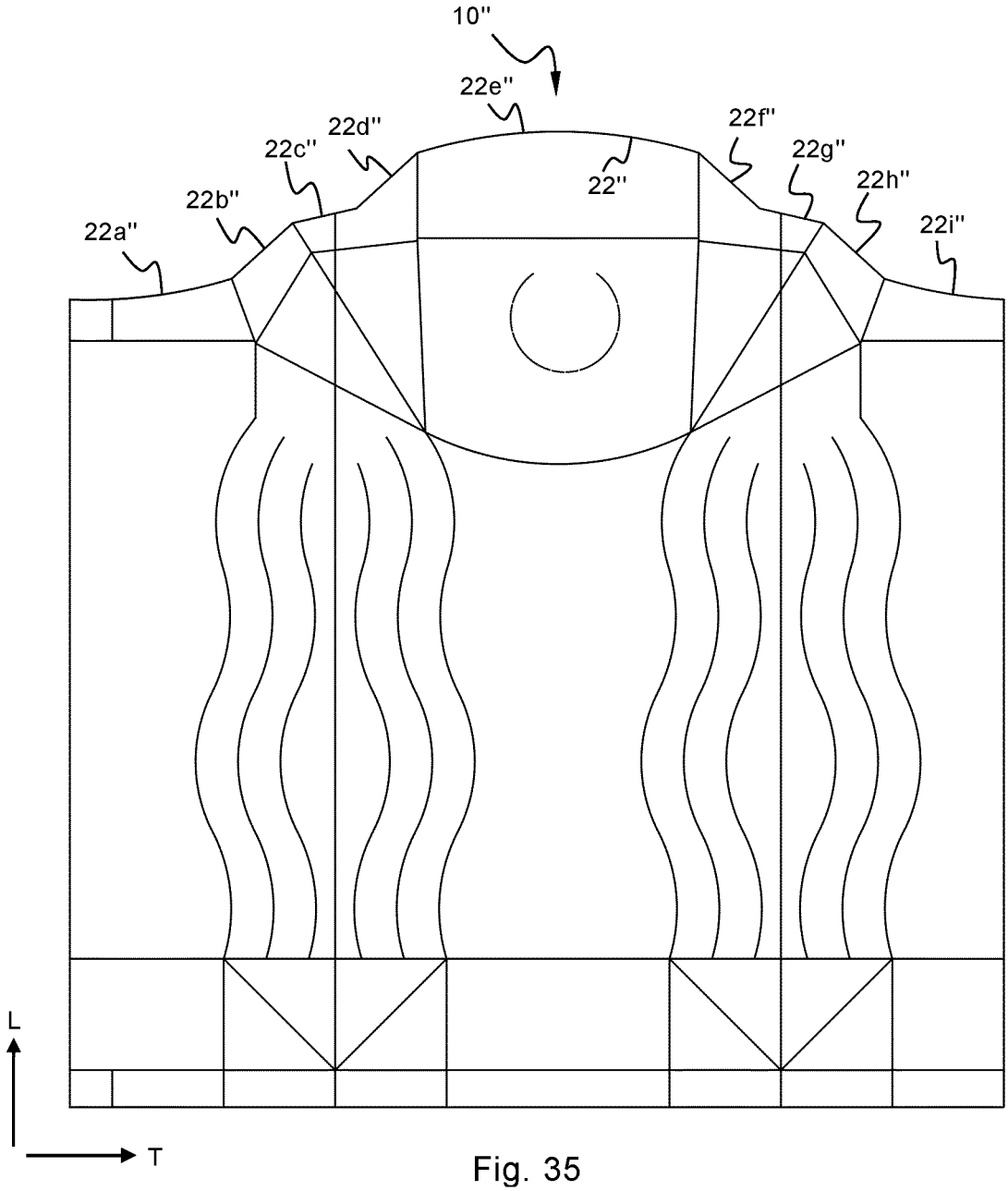
FIG. 35 shows a blank produced from the nesting pattern of FIG. 34.
Figure 36:
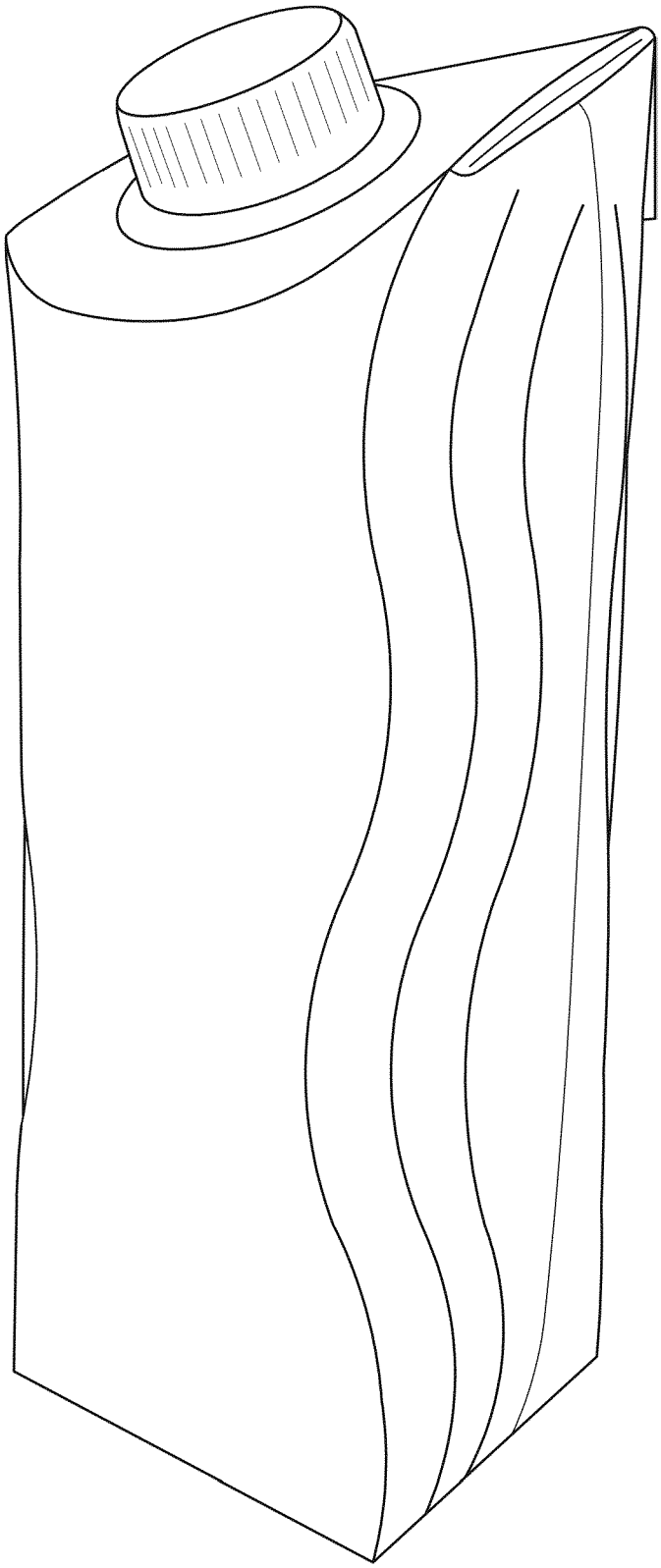
FIG. 36 shows a container produced from the blank according to FIG. 35.

In FIG. 31, the top boundary edge sections 22*a* and 22*i* are equally long and top boundary edge section 22*e* is twice as long as any one of edge sections 22*a* and 22*i*. However, it is understood that an efficient nesting pattern can be achieved also with other geometries. FIG. 34 shows a further embodiment of a nesting pattern of blanks laid out on a web of a laminate material and FIG. 35 shows a blank 10" cut and embossed according to the nesting pattern shown in FIG. 34. In this embodiment, the top boundary edge 22" comprises curvilinear edge sections 22*a*" and 22*e*" and 22*i*" having an extend and a curvature allowing the nesting patter to be laid out with the top boundary edges of the blanks adjoining each other without an intermediate gap, as is illustrated in FIG. 34. Once cut out from the laminate material web, the blank 10" can be folded, filled and sealed in a manner similar to the blank 10 disclosed in FIG. 1. FIG. 36 shows a container 100" produced from the blank 10" according to FIG. 35.

It is appreciated that certain features of the invention, which, for clarity, have been described above in the context of separate embodiments, may also be provided in combination in a single embodiment. Conversely, various features of the invention, which, for brevity, have been described in the context of a single embodiment, may also be provided separately or in any suitable sub-combination.

In the preceding description, various aspects of the blank and container according to the invention have been described with reference to the illustrative embodiment. For purposes of explanation, specific numbers, systems and configurations were set forth in order to provide a thorough understanding of the apparatus and its workings. However, this description is not intended to be construed in a limiting sense. Various modifications and variations of the illustrative embodiment, as well as other embodiments of the apparatus, which are apparent to person skilled in the art to which the disclosed subject-matter pertains, may lie within the scope of the present invention as defined by the following claims.

The invention claimed is:

1. A paper-based or paperboard-based container for holding a pourable food product, comprising:

a substantially planar bottom portion;

a top portion arranged opposite the bottom portion and comprising a top panel and a top sealing region forming a top seal of the container;

an opening device or closure being arranged in the top panel for dispensing and/or accessing the food product; and a wall portion extending between the bottom portion and the top portion and comprising a plurality of wall sections bordering the top panel and a longitudinal sealing band extending between the bottom portion and the top portion over at least one of the wall sections;

wherein the top sealing region comprising a plurality of sealed sealing band panels, the top sealing region being folded onto said at least one of the wall sections comprising the longitudinal sealing band and being attached thereto, the top panel being free from sealing structures.

2. The container according to claim 1, wherein the container comprising gusset panels being folded onto each other underneath the top panel.

3. The container according to claim 1, wherein the top sealing region being substantially planar and arranged substantially parallel to said at least one of the wall sections comprising the longitudinal sealing band.

4. The container according to claim 1, wherein the top panel and the top sealing region sharing a common border forming a top edge of the container.

5. The container according to claim 4, wherein the top edge being substantially rectilinear and arranged parallel to the bottom portion.

6. The container according to claim 5, wherein the opening device or closure comprising an opening being arranged adjacent said top edge.

7. The container according to claim 6, wherein the opening being arranged at an orthogonal distance of between 1 mm to 10 mm from the top edge.

8. The container according to claim 1, wherein the top panel—and said at least one of the wall sections comprising the longitudinal sealing band being substantially planar, and by the top panel forming an angle to said at least one of the wall sections comprising the longitudinal sealing band that is of any one of: within the range of 10 degrees to 90 degrees; within the range of 30 degrees to 80 degrees, within the range of 45 degrees to 75 degrees; and 60 degrees.

9. The container according to claim 1, wherein all of the sealed sealing band panels of the top sealing region being arranged substantially parallel and/or substantially coplanar.

10. The container according to claim 9, wherein the sealing band panels comprises a central sealing band panel having a longitudinal extent being any one of: at least 15 mm, at least 20 mm and at least 30 mm.

11. A paper-based or paperboard-based sleeve for producing the container according to claim 1.

12. A paper-based or paperboard-based blank for producing the sleeve according to claim 11.

13. The blank according to claim 12, wherein a top region comprising a top panel and gusset panels configured to be folded onto each other underneath the top panel.

14. The blank according to claim 12, wherein the blank being mirror-symmetric about a longitudinal central axis of the blank.

15. A method of producing a paper-based or paperboard-based container for holding a pourable food product comprising the steps of:

sealing a paper-based or paperboard-based laminate sheet material along a longitudinal sealing band forming a tubular proto-container;

top-sealing the proto-container at a top sealing region forming a plurality of sealed sealing band panels; and folding the top sealing region comprising the sealed sealing band panels onto at least one wall section of the proto-container comprising said longitudinal sealing band and attaching the top sealing region to said at least one wall section.

16. The method according to claim 15, comprising a step of forming a top portion of the container by folding gusset panels of the laminate sheet material onto each other underneath a top panel of the laminate sheet material.

17. The method according to claim 16, comprising a step of arranging an opening device or a closure for dispensing or accessing the food product in the top portion.

18. The method according to claim 15, comprising the steps of:

bottom-sealing the laminate sheet material to form a bottom-sealed and open-top proto-container; and filling the bottom-sealed and open-top proto-container with the pourable food product, wherein said step of top-sealing the laminate sheet material is performed after said step of filling the bottom-sealed and open-top proto-container with the pourable food product.

19. The method according to claim 15, wherein said step of top-sealing the proto-container produces a top-sealed and open-bottom proto-container, the method further comprising the steps of:

filling the top-sealed and open-bottom proto-container with the pourable food product; and bottom-sealing the laminate sheet material.

* * * * *